US007762589B2

(12) United States Patent
Hough et al.

(10) Patent No.: US 7,762,589 B2
(45) Date of Patent: Jul. 27, 2010

(54) SPINE LABEL INSERT FOR A DOCUMENT STORAGE DEVICE

(75) Inventors: Jack B. Hough, Chicago, IL (US); Sue Y. Kim, Niles, IL (US); Stephen P. Corr, Gurnee, IL (US); Timothy P. Grady, Cary, IL (US); Marilyn J. Morgan, Downers Grove, IL (US); Philip E. Hague, Chicago, IL (US); Jason C. Campbell, Chicago, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 473 days.

(21) Appl. No.: 11/550,544

(22) Filed: Oct. 18, 2006

(65) Prior Publication Data

US 2007/0086846 A1 Apr. 19, 2007

Related U.S. Application Data

(62) Division of application No. 10/768,850, filed on Jan. 30, 2004, now Pat. No. 7,320,554.

(51) Int. Cl.
*B42D 3/00* (2006.01)
*B42D 3/18* (2006.01)
*B42D 3/08* (2006.01)

(52) U.S. Cl. ..... 281/29; 281/31; 281/15.1; 281/51

(58) Field of Classification Search ..... 402/500, 402/76; 281/15.1, 19.1, 29, 31, 36, 34, 37, 281/32, 20, 51; 283/36–42; 116/234–239; 40/726

See application file for complete search history.

(56) References Cited

U.S. PATENT DOCUMENTS

| | | | |
|---|---|---|---|
| 134,249 | A | 12/1872 | Burlock |
| 170,042 | A | 11/1875 | Anthony |
| 384,697 | A | 6/1888 | Kelly |
| 478,390 | A | 7/1892 | Bergner |
| 498,761 | A | 6/1893 | Becker |
| 720,324 | A | 2/1903 | Bushnell, Jr. |
| 757,596 | A | 4/1904 | Bushnell, Jr. |
| 868,998 | A | 10/1907 | Lang |
| 1,023,834 | A | 4/1912 | Gareis |
| 1,029,280 | A | 6/1912 | Davidson |
| 1,065,414 | A | 6/1913 | Wiesner |
| 1,194,401 | A | 8/1916 | Lindstrom |

(Continued)

FOREIGN PATENT DOCUMENTS

| | | |
|---|---|---|
| CA | 2198056 | 10/2000 |

(Continued)

*Primary Examiner*—Dana Ross
*Assistant Examiner*—Pradeep C Battula
(74) *Attorney, Agent, or Firm*—Michael Best & Friedrich LLP

(57) ABSTRACT

A document storage device is configured to receive a spine label. The document storage device includes a spine, a spine cover cooperating with the spine to define a pocket, and a sleeve member operable to at least partially surround the spine label to define a removable spine insert that is inserted into the pocket. The sleeve member remains in the pocket with the spine label and is removable from the pocket to remove the spine label.

20 Claims, 18 Drawing Sheets

U.S. PATENT DOCUMENTS

| | | | | |
|---|---|---|---|---|
| 1,330,894 | A | | 2/1920 | Muffley |
| 1,381,674 | A | | 6/1921 | Simpson |
| 1,435,762 | A | | 11/1922 | Tomsich |
| 1,634,064 | A | | 6/1927 | Ahlquist |
| 1,673,144 | A | | 6/1928 | Barclay |
| 1,677,277 | A | | 7/1928 | Federbush et al. |
| 1,696,629 | A | | 12/1928 | Fenno |
| 1,723,096 | A | | 8/1929 | Taylor |
| 1,832,715 | A | | 11/1931 | London |
| 1,865,741 | A | | 7/1932 | Carney |
| 1,965,679 | A | | 7/1934 | Welliver et al. |
| 1,975,559 | A | | 10/1934 | Smith |
| 2,088,672 | A | | 8/1937 | Steinthal |
| 2,088,953 | A | | 8/1937 | Greer |
| 2,150,474 | A | | 3/1939 | Williams |
| 2,239,145 | A | | 4/1941 | Doner |
| 2,304,980 | A | | 12/1942 | Williams et al. |
| 2,390,958 | A | | 12/1945 | Perlin |
| 2,422,235 | A | | 6/1947 | Greene |
| 2,477,840 | A | | 8/1949 | Vasilas |
| 2,523,129 | A | | 9/1950 | Maier |
| 2,532,132 | A | | 11/1950 | Vogel |
| 2,544,566 | A | | 3/1951 | Rose |
| 2,568,178 | A | | 9/1951 | Widder |
| 2,596,131 | A | | 5/1952 | Sinkler et al. |
| 2,598,755 | A | | 6/1952 | Birch |
| 2,616,431 | A | | 11/1952 | Kalwajtys |
| 2,639,168 | A | | 5/1953 | Coppock |
| 2,639,254 | A | | 5/1953 | Smith |
| 2,701,426 | A | | 2/1955 | Vlock |
| 2,704,546 | A | | 3/1955 | Slonneger |
| 2,716,985 | A | | 9/1955 | Wolf |
| 2,742,070 | A | | 4/1956 | Jones |
| 2,755,837 | A | | 7/1956 | Kosek |
| 2,801,115 | A | | 7/1957 | Federbush et al. |
| 2,828,975 | A | | 4/1958 | Wright |
| 2,842,882 | A | | 7/1958 | Greene et al. |
| 2,850,294 | A | | 9/1958 | Ortis et al. |
| 2,852,275 | A | | 9/1958 | Brook |
| 2,935,807 | A | | 5/1960 | Townsend, Jr. et al. |
| 3,092,400 | A | | 6/1963 | Smith |
| 3,133,750 | A | | 5/1964 | Gerald |
| 3,175,847 | A | | 3/1965 | McKowen |
| 3,241,863 | A | | 3/1966 | Paddack |
| 3,252,462 | A | | 5/1966 | Quarton et al. |
| 3,301,621 | A | * | 1/1967 | Stephenson ..... 312/234 |
| 3,431,667 | A | | 3/1969 | Woods |
| 3,473,246 | A | | 10/1969 | Parobek |
| 3,485,564 | A | | 12/1969 | Holes et al. |
| 3,492,743 | A | | 2/1970 | Schmidt |
| 3,589,049 | A | | 6/1971 | Cornelius |
| 3,663,041 | A | | 5/1972 | White |
| 3,807,883 | A | | 4/1974 | Karlsson |
| 3,810,324 | A | | 5/1974 | Hart |
| 3,814,527 | A | | 6/1974 | Lawes |
| 3,822,495 | A | | 7/1974 | Ohfuji |
| 3,870,223 | A | | 3/1975 | Wyant |
| 3,899,082 | A | | 8/1975 | Young et al. |
| 3,937,493 | A | | 2/1976 | Fasbender |
| 4,001,960 | A | | 1/1977 | Holson |
| 4,164,085 | A | | 8/1979 | Steeb et al. |
| 4,172,332 | A | | 10/1979 | Holes et al. |
| 4,175,777 | A | | 11/1979 | Horn |
| 4,215,499 | A | | 8/1980 | Wilson |
| 4,275,517 | A | | 6/1981 | Blanchard |
| 4,294,469 | A | | 10/1981 | Errichiello |
| 4,315,642 | A | | 2/1982 | Errichiello |
| 4,332,095 | A | | 6/1982 | Tanney |
| 4,336,754 | A | | 6/1982 | Loeb |
| 4,378,647 | A | | 4/1983 | Stancato |
| 4,420,112 | A | | 12/1983 | Cline |
| D272,161 | S | | 1/1984 | Lodge et al. |
| 4,531,765 | A | | 7/1985 | Shulman |
| 4,566,721 | A | | 1/1986 | Friedman et al. |
| 4,600,346 | A | | 7/1986 | Podosek |
| 4,605,245 | A | | 8/1986 | Weaver |
| 4,629,349 | A | | 12/1986 | Pitts |
| 4,630,843 | A | | 12/1986 | Willat |
| 4,640,413 | A | | 2/1987 | Kaplan et al. |
| D289,530 | S | | 4/1987 | Arrington |
| 4,681,472 | A | | 7/1987 | Ruble |
| D293,335 | S | | 12/1987 | Egly |
| 4,750,884 | A | | 6/1988 | Bourgeois et al. |
| 4,780,975 | A | | 11/1988 | Friedman |
| 4,795,194 | A | | 1/1989 | Etheredge |
| 4,809,451 | A | | 3/1989 | Suzuki |
| 4,813,803 | A | | 3/1989 | Gross |
| 4,828,421 | A | | 5/1989 | Arakaki |
| 4,830,404 | A | | 5/1989 | Lu |
| 4,831,756 | A | | 5/1989 | Huang et al. |
| 4,832,369 | A | | 5/1989 | Johnson et al. |
| 4,835,756 | A | | 5/1989 | Kaku et al. |
| 4,838,724 | A | | 6/1989 | Spence, Jr. |
| 4,848,798 | A | | 7/1989 | Moor |
| 4,856,817 | A | | 8/1989 | Moor |
| D303,548 | S | | 9/1989 | Rexroat et al. |
| 4,886,299 | A | | 12/1989 | Ducorday |
| 4,890,728 | A | | 1/1990 | Grimsley |
| 4,892,333 | A | | 1/1990 | Krulich |
| 4,916,838 | A | | 4/1990 | Holson |
| 4,934,739 | A | | 6/1990 | Stancato |
| 4,962,951 | A | | 10/1990 | Mechesney |
| D313,619 | S | | 1/1991 | Moor |
| 4,991,767 | A | | 2/1991 | Wyant |
| 4,998,840 | A | | 3/1991 | Ruble |
| 5,000,319 | A | | 3/1991 | Mermelstein |
| 5,002,311 | A | | 3/1991 | Brunjes |
| 5,015,011 | A | | 5/1991 | York |
| 5,020,828 | A | | 6/1991 | Moor |
| 5,030,027 | A | | 7/1991 | Bachrach et al. |
| 5,056,825 | A | | 10/1991 | Templet |
| 5,059,052 | A | | 10/1991 | Casper |
| 5,067,840 | A | | 11/1991 | Cooper et al. |
| 5,074,593 | A | | 12/1991 | Grosso |
| 5,090,732 | A | | 2/1992 | Kuhns et al. |
| 5,100,253 | A | | 3/1992 | Cooper |
| D325,928 | S | | 5/1992 | Bourgeois |
| 5,114,009 | A | | 5/1992 | Johnston |
| 5,118,137 | A | | 6/1992 | Walters |
| 5,160,001 | A | | 11/1992 | Marceau |
| 5,163,768 | A | | 11/1992 | Salisbury et al. |
| 5,199,809 | A | | 4/1993 | Semerjian |
| 5,213,368 | A | | 5/1993 | Wyant |
| 5,219,437 | A | | 6/1993 | Moor et al. |
| 5,222,825 | A | | 6/1993 | Wyant |
| 5,240,340 | A | | 8/1993 | Lynch et al. |
| D340,068 | S | | 10/1993 | Chan |
| 5,261,701 | A | | 11/1993 | Walters |
| 5,265,359 | A | | 11/1993 | Glazer et al. |
| D343,646 | S | | 1/1994 | Semerjian et al. |
| 5,286,128 | A | | 2/1994 | Gillum |
| 5,299,879 | A | | 4/1994 | Burrow |
| 5,330,279 | A | | 7/1994 | Ruble |
| 5,330,281 | A | | 7/1994 | Kalan |
| D349,514 | S | | 8/1994 | Gotlund |
| 5,340,155 | A | | 8/1994 | Podosek |
| D350,983 | S | | 9/1994 | Penniman |
| 5,368,333 | A | | 11/1994 | Arroyo |
| 5,383,568 | A | | 1/1995 | Tusick et al. |
| 5,393,154 | A | | 2/1995 | Hubbell |
| D356,337 | S | | 3/1995 | Douglas |
| 5,395,137 | A | * | 3/1995 | Kim ..... 283/81 |
| 5,411,293 | A | | 5/1995 | Monzyk |
| 5,431,449 | A | | 7/1995 | Arimoto et al. |

| | | | | |
|---|---|---|---|---|
| 5,437,514 | A | 8/1995 | Minch | |
| 5,441,357 | A | 8/1995 | Wilson | |
| 5,445,251 | A | 8/1995 | Redwood | |
| 5,445,417 | A | 8/1995 | Bromer et al. | |
| 5,449,202 | A | 9/1995 | Nalepka et al. | |
| 5,461,810 | A | 10/1995 | Goserud | |
| D365,361 | S | 12/1995 | Smith et al. | |
| 5,490,739 | A | 2/1996 | Olson | |
| 5,503,487 | A | 4/1996 | Ong | |
| 5,509,746 | A | 4/1996 | Ho | |
| 5,562,309 | A | 10/1996 | Brink et al. | |
| 5,564,623 | A | 10/1996 | Kiley | |
| 5,569,503 | A | 10/1996 | Piotroski | |
| 5,584,387 | A | 12/1996 | Grant | |
| 5,605,354 | A | 2/1997 | Kwon | |
| 5,607,246 | A | 3/1997 | Podosek | |
| 5,618,061 | A | 4/1997 | Ritterling | |
| 5,620,207 | A | 4/1997 | Podosek et al. | |
| 5,642,954 | A | 7/1997 | Hudspith | |
| 5,651,628 | A | 7/1997 | Bankes et al. | |
| 5,660,514 | A | 8/1997 | Wilson | |
| 5,671,950 | A | 9/1997 | Hanson | |
| 5,674,021 | A | 10/1997 | Hutnick | |
| 5,676,482 | A | 10/1997 | Hawkins | |
| 5,683,111 | A | 11/1997 | Bass et al. | |
| 5,711,627 | A * | 1/1998 | Chapman | 402/3 |
| 5,720,564 | A | 2/1998 | Winzen | |
| 5,762,375 | A | 6/1998 | Kogutt et al. | |
| 5,785,445 | A | 7/1998 | Podosek et al. | |
| 5,826,851 | A | 10/1998 | Arbisi | |
| 5,836,507 | A | 11/1998 | Mueller et al. | |
| 5,853,259 | A | 12/1998 | Murray, Jr. | |
| 5,857,797 | A | 1/1999 | Streff et al. | |
| D405,825 | S | 2/1999 | Karten | |
| D406,602 | S | 3/1999 | Karten | |
| D406,603 | S | 3/1999 | Karten | |
| 5,876,143 | A | 3/1999 | Ong | |
| 5,882,038 | A | 3/1999 | Ong | |
| D409,385 | S | 5/1999 | Pearson et al. | |
| 5,911,441 | A | 6/1999 | Yamamoto et al. | |
| D412,530 | S | 8/1999 | Bould | |
| 5,944,352 | A | 8/1999 | Crouch et al. | |
| D413,923 | S | 9/1999 | Brown et al. | |
| D413,924 | S | 9/1999 | Bould | |
| 5,947,524 | A | 9/1999 | Podosek | |
| 5,951,189 | A | 9/1999 | Winzen | |
| D414,801 | S | 10/1999 | Karten et al. | |
| D417,697 | S | 12/1999 | Long et al. | |
| D417,890 | S | 12/1999 | Joe et al. | |
| 6,012,866 | A | 1/2000 | Podosek | |
| 6,017,164 | A | 1/2000 | Abbott | |
| 6,019,540 | A * | 2/2000 | Senior | 283/81 |
| 6,030,139 | A | 2/2000 | Ray | |
| 6,030,140 | A | 2/2000 | Karten et al. | |
| D421,460 | S | 3/2000 | Joe et al. | |
| 6,032,984 | A | 3/2000 | Ishida | |
| D423,044 | S | 4/2000 | Burke et al. | |
| 6,045,161 | A | 4/2000 | Ashcraft et al. | |
| 6,047,990 | A | 4/2000 | Mogelonsky et al. | |
| 6,068,423 | A | 5/2000 | Owen | |
| 6,086,105 | A | 7/2000 | Woldenberg et al. | |
| 6,086,106 | A | 7/2000 | Joe et al. | |
| 6,095,564 | A | 8/2000 | Wien | |
| 6,109,812 | A | 8/2000 | Welch | |
| 6,117,264 | A | 9/2000 | Brewster | |
| 6,149,205 | A | 11/2000 | Attia et al. | |
| D435,269 | S | 12/2000 | Karten et al. | |
| 6,161,979 | A | 12/2000 | Yamamoto et al. | |
| 6,186,690 | B1 | 2/2001 | Duncan | |
| 6,206,602 | B1 | 3/2001 | Yamamoto et al. | |
| 6,213,669 | B1 | 4/2001 | Yamamoto | |
| 6,213,670 | B1 | 4/2001 | Wien | |
| 6,227,746 | B1 | 5/2001 | Long et al. | |
| 6,234,701 | B1 | 5/2001 | Karten et al. | |
| 6,241,414 | B1 | 6/2001 | Wien | |
| 6,250,834 | B1 | 6/2001 | Wien | |
| 6,261,021 | B1 | 7/2001 | Pfanner et al. | |
| 6,276,862 | B1 | 8/2001 | Snyder et al. | |
| 6,290,421 | B1 | 9/2001 | Welch | |
| 6,293,722 | B1 | 9/2001 | Holbrook et al. | |
| 6,296,727 | B1 | 10/2001 | Chang et al. | |
| 6,302,443 | B1 | 10/2001 | Ashcraft et al. | |
| 6,305,714 | B1 | 10/2001 | Rossetto et al. | |
| 6,358,587 | B1 | 3/2002 | Saint et al. | |
| 6,361,236 | B1 | 3/2002 | Podosek | |
| 6,361,639 | B1 | 3/2002 | Owen et al. | |
| 6,367,842 | B1 | 4/2002 | Wien et al. | |
| 6,368,005 | B1 | 4/2002 | Streff et al. | |
| 6,375,604 | B1 | 4/2002 | Verhines | |
| 6,409,409 | B2 | 6/2002 | Bauman et al. | |
| 6,450,399 | B1 | 9/2002 | Attia et al. | |
| 6,478,336 | B2 | 11/2002 | Tran | |
| 6,481,572 | B2 | 11/2002 | Wien et al. | |
| 6,488,433 | B2 | 12/2002 | Wien et al. | |
| 6,550,812 | B1 | 4/2003 | Castillo et al. | |
| D476,682 | S | 7/2003 | Berry et al. | |
| D478,349 | S | 8/2003 | Capaci | |
| 6,607,216 | B1 | 8/2003 | Stenger et al. | |
| 6,682,247 | B1 * | 1/2004 | Castillo et al. | 402/73 |
| 6,761,498 | B1 * | 7/2004 | Harris et al. | 402/73 |
| 6,902,340 | B2 * | 6/2005 | Harris et al. | 402/73 |
| 7,077,596 | B1 | 7/2006 | Bianco et al. | |
| 2002/0159816 | A1 | 10/2002 | Gagnon, Jr. et al. | |
| 2003/0044222 | A1 | 3/2003 | Dahlke et al. | |
| 2004/0069841 | A1 | 4/2004 | Wong et al. | |
| 2005/0046173 | A1 | 3/2005 | Hall et al. | |
| 2005/0226681 | A1 | 10/2005 | Merzon | |
| 2007/0086841 | A1 | 4/2007 | Merzon | |

FOREIGN PATENT DOCUMENTS

| | | |
|---|---|---|
| GB | 363876 | 12/1931 |
| SE | 175812 | 6/1961 |
| SE | 200241 | 12/1965 |
| SE | 7801725 | 4/1979 |
| WO | WO 92/21524 | 12/1992 |
| WO | WO 99/26791 | 6/1999 |

* cited by examiner

SPINE LABEL INSERT FOR A DOCUMENT STORAGE DEVICE

RELATED APPLICATIONS

This application is a divisional of U.S. application Ser. No. 10/768,850 filed Jan. 30, 2004, the entire content of which is hereby incorporated by reference.

BACKGROUND

The present invention generally relates to document storage devices such as binders, folders, folios, report covers, and the like. More specifically, the present invention relates to the cover construction of document storage devices.

Document storage devices are often used to contain loose materials related to a common subject. For example, students sometimes use three ring binders to contain class notes for one or more classes. In business, important papers or records related to a common subject or a project are sometimes kept in binders. In addition, procedures, processes, forms, and other documents are conveniently stored within binders.

Because binders often look similar, it is convenient to apply a spine label to a spine of the binder and/or a title sheet to a front cover of the binder to identify the contents of the binder. Some vinyl-covered binders provide clear pockets open at least one end to receive these spine labels and title sheets. However, these pockets are often difficult to use because it is often difficult to position the spine label or title sheet as desired within the pocket. In addition, it is sometimes difficult to remove the spine label or title sheet without stretching, damaging, or marring the surface that covers the spine label or title sheet.

Other binders are not well suited for spine label or title sheet pockets. For example, many molded and die-cut binders are not receptive to the placement of an exterior pocket on the front cover or the spine.

While some vinyl-covered binders include pockets to receive spine labels or title sheets, the configuration of the pockets makes it difficult to remove or insert a spine label or title sheet.

SUMMARY

The present invention provides a document storage device configured to receive a spine label. The document storage device includes a spine, a spine cover cooperating with the spine to define a pocket, and a sleeve member operable to at least partially surround the spine label to define a removable spine insert that is inserted into the pocket. The sleeve member remains in the pocket with the spine label and is removable from the pocket to remove the spine label.

In one embodiment, the sleeve member includes a tab at an end to facilitate removal of the spine insert from the pocket. The spine cover can further include a cut-out, such that the tab is positioned at the cut-out when the sleeve member is inserted in the pocket to facilitate grasping the tab.

In another embodiment, the sleeve member includes a first portion and a second portion connected along a hinge. Each of the first and second portions can be substantially planar, and the sleeve member can be symmetrical about the hinge. In one embodiment, the hinge is substantially entirely within the pocket when the spine insert is inserted in the pocket.

The invention also provides a method of labeling the spine of a document storage device having a spine pocket. The method includes providing a spine label, at least partially surrounding the spine label with a sleeve member to define a spine insert, inserting the spine insert into the spine pocket, and leaving the spine insert in the pocket until the label is changed.

In one embodiment, the sleeve member includes a first portion and a second portion connected along a hinge. At least partially surrounding the spine label with a sleeve member includes inserting the spine label between the first and second portions.

Additional features and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

Figure 1:
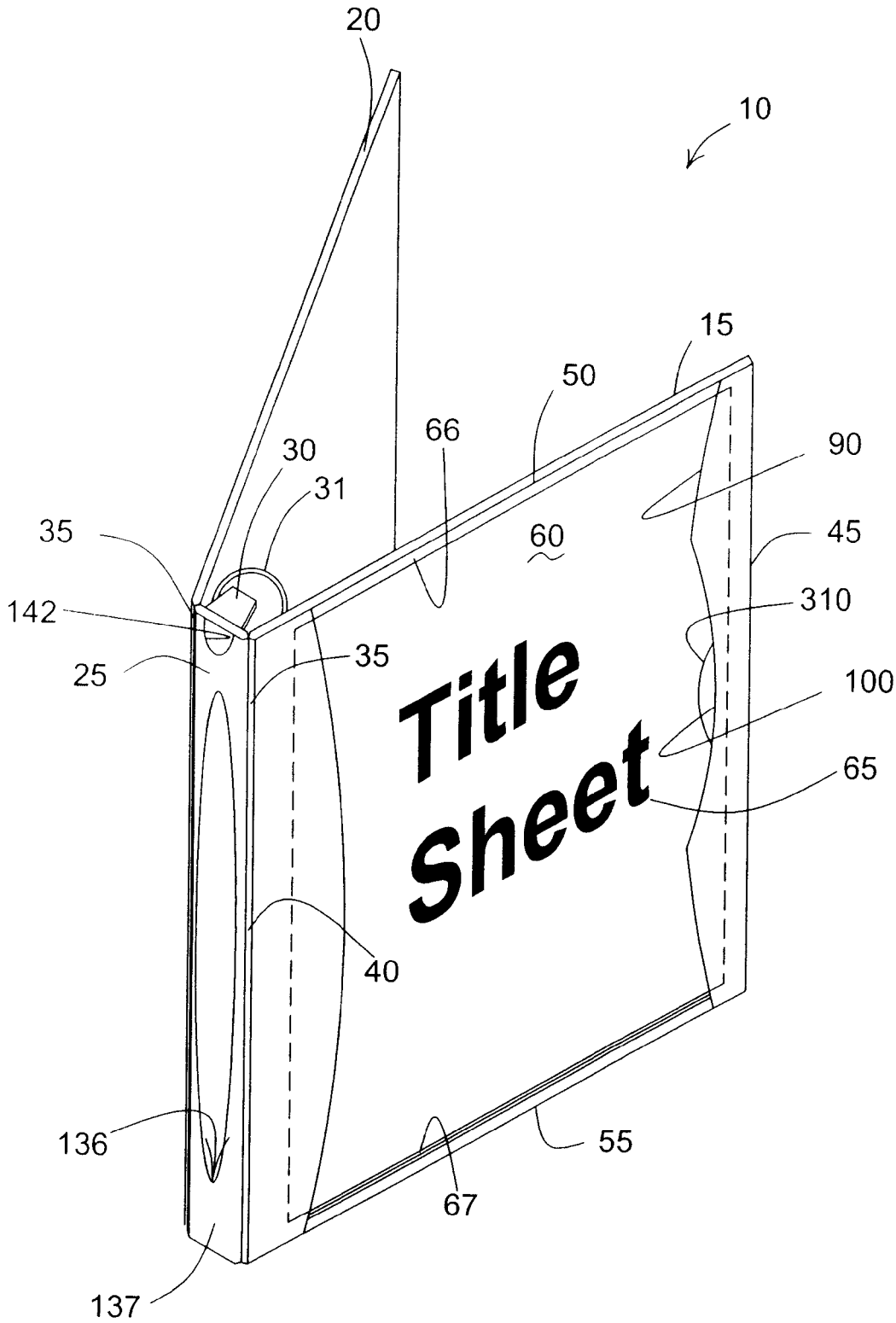
FIG. 1 is a perspective view of a ring binder.
Figure 2:
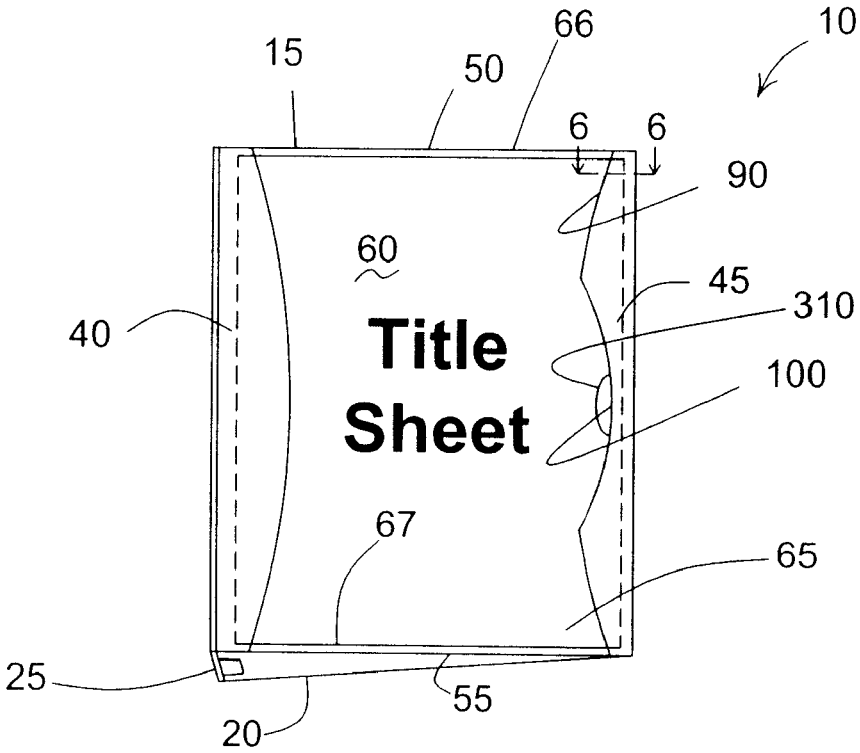
FIG. 2 is a perspective view of the ring binder of FIG. 1 showing the front cover.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The terms "connected," "coupled," and "mounted" and variations thereof are used broadly and encompass direct and indirect connections, couplings, and mountings. In addition, the terms "connected," "coupled," and "mounted" and variations thereof are not restricted to physical or mechanical connections or couplings.

DETAILED DESCRIPTION OF THE DRAWINGS

While illustrated and described below as being applied to one or more binders, the features of the present invention are also capable of being applied to other DSDs, such as folders, report covers, folios, and the like. Therefore, the present invention need not be limited to binder applications.

FIG. 1 illustrates a molded plastic binder 10 that includes a front cover 15, a rear cover 20, and a spine 25. The molded plastic binder 10 is formed from a substantially homogeneous plastic material in one or more manufacturing steps. The binder 10 of FIG. 1 also includes a ring mechanism 30 attached to the inner surface of one or more of the front cover 15, the rear cover 20, and the spine 25. The ring mechanism 30 includes at least one ring 31 movable between an open position and a closed position. While the illustrated binder 10 includes the ring mechanism 30, other binders suited to use with the present invention may not include the ring mechanism 30.

The front cover 15 and the rear cover 20 are substantially flat rectangular portions of the binder 10 that connect to the spine 25 along hinges 35. The hinges 35 are generally thin flexible connections that allow the front cover 15 and the rear cover 20 to pivot relative to the spine 25 between an open position and a closed position. The front cover 15 defines a spine edge 40 adjacent the spine 25 and a lip edge 45 opposite and substantially parallel to the spine edge 40. A top edge 50 extends between the lip edge 45 and the spine edge 40 along the top of the front cover 15, and a bottom edge 55 extends between the lip edge 45 and the spine edge 40 along the bottom of the front cover 15.

A translucent cover sheet 60 is attached to the front cover 15. In preferred constructions, the cover sheet 60 is transparent to allow the uninhibited viewing of a title sheet 65 disposed within a title sheet space between the cover sheet 60 and the front cover 15. In other constructions, the cover sheet 60 may include a pattern that enhances or otherwise affects the view of the title sheet 65 through the cover sheet 60.

Figure 3:
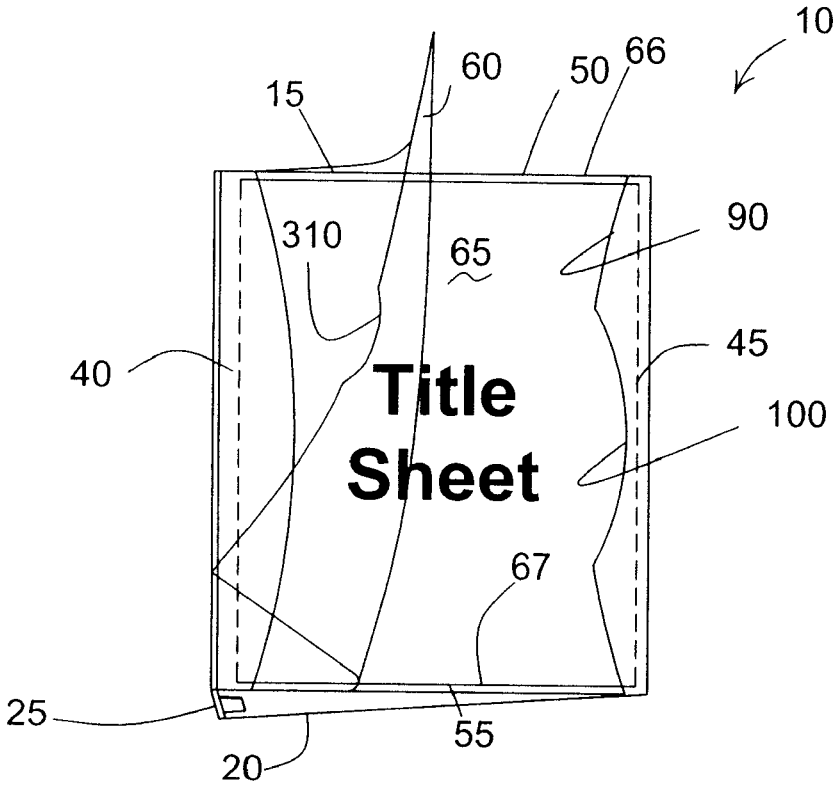
FIG. 3 is a perspective view of the ring binder of FIG. 1 showing the front cover with a cover sheet in an open position.
Figure 4:
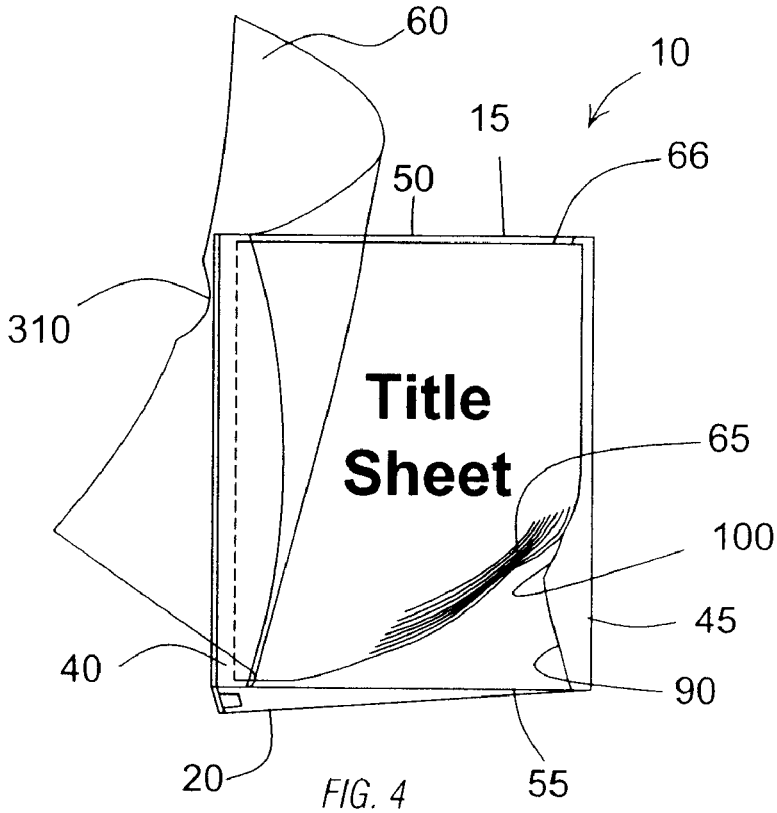
FIG. 4 is a perspective view of the ring binder of FIG. 1 with the cover sheet in the open position and a title sheet lifted.
Figure 5:
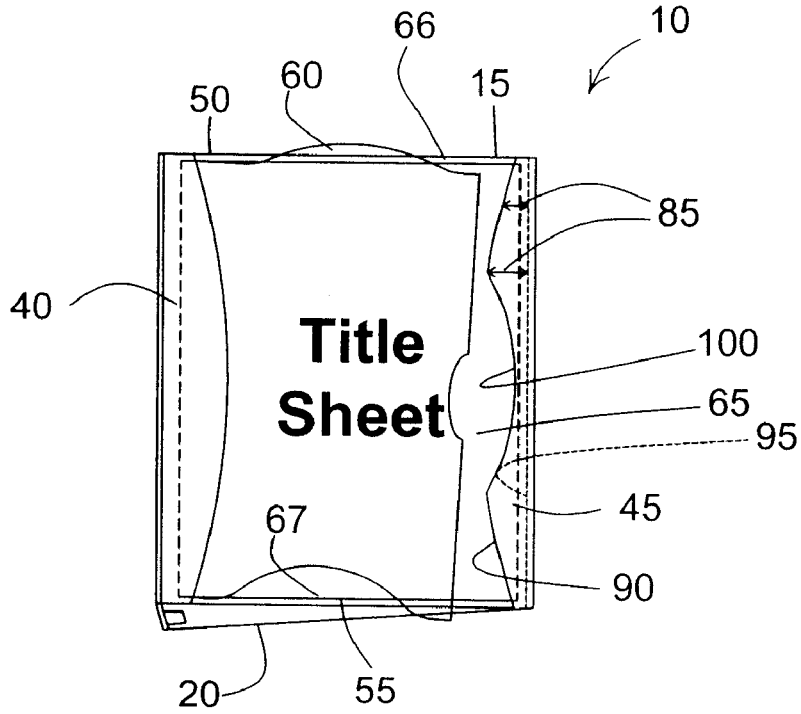
FIG. 5 is a perspective view of the ring binder of FIG. 1 with the cover sheet in a partially closed position.

The cover sheet 60 attaches to the front cover 15 or is formed as part of the front cover 15 such that it is substantially fixed at or adjacent to the spine edge 40 and is free along the remaining three cover edges 45, 50, 55. The cover sheet 60 attaches to the front cover to define a hinge portion using any suitable means including but not limited to welding, adhesive, fasteners, and the like. In many constructions, a pocket is formed adjacent the hinge portion to receive a portion of the title sheet 65. Other constructions may fix other edges of the cover sheet 60 such as the edge adjacent the top edge 50, the bottom edge 55, or the lip edge 45. No matter which edge is fixed, the remaining three edges should remain free to allow the cover sheet 60 to move by pivoting about the hinge portion between a closed and an open position, as shown in FIGS. 3-5. A cut-out portion 310 is provided to aid a user in grabbing or moving the cover sheet 60. The cut-out portion 310 establishes an edge that a user can grab no matter the position of the cover sheet 60.

Turning to FIG. 3, the cover sheet 60 is shown in an open position. As can be seen, the edges of the cover sheet 60 adjacent the lip edge 45, the top edge 50, and the bottom edge 55 are free to move relative to the front cover 15. Once in the open position, the title sheet 65 can be inserted or removed as desired, as shown in FIG. 4. The cover sheet 60 covers, protects, and retains the title sheet 65 in the desired position on the front cover 15.

Once the title sheet 65 is positioned, or removed, the cover sheet 60 can be returned to the closed position as illustrated in FIG. 5. Both the title sheet 65 and cover sheet 60 engage and are tucked under the lip edge 45 to retain them in the closed position during binder use. When the cover sheet 60 is in the closed position, the edges adjacent the top edge 50 and the bottom edge 55 are not secured to the front cover 15. No additional securing device other than the lip edge 45 is needed to retain the cover sheet 60 in the closed position. In some constructions, static electricity and pressure forces (i.e., the low pressure between the cover sheet 60 and the front cover 15 and title sheet 65 created as they are separated) aid in holding the cover sheet 60 in the closed position.

In some constructions, the front cover 15 includes a top lip 66 formed adjacent the top edge 50 and a bottom lip 67 formed adjacent the bottom edge 55. The top lip 66 and the bottom lip 67, shown in FIG. 1 engage the title sheet 65 and inhibit its escape through the open top and bottom edges when the cover sheet 60 is in the closed position. The top lip 66 and bottom lip 67 may be continuous and extend completely across the top edge 50 and the bottom edge 55 or may extend along only a portion of the edges 50, 55. In addition, one or both of the lip edges may be made up of intermittent lips that extend across all or a portion of the top edge 50 and bottom edge 55. Furthermore, while it is preferred that the top lip 66 and the bottom lip 67 be formed as part of the front cover 15, other constructions include separate pieces that attach to the front cover using any suitable attachment method.

One of ordinary skill will realize that when the cover sheet edge adjacent the lip edge 45 is engaged with (e.g., tucked under) the lip edge 45, a small portion of the cover sheet edges adjacent the top edge 50 and the bottom edge 55 are also engaged by the lip edge 45. Thus, while these edges of the cover sheet 60 are not totally free to move, a majority of the cover sheet edges adjacent the top edge and the bottom edge remain free. As such, these edges should still be considered free.

Figure 6:
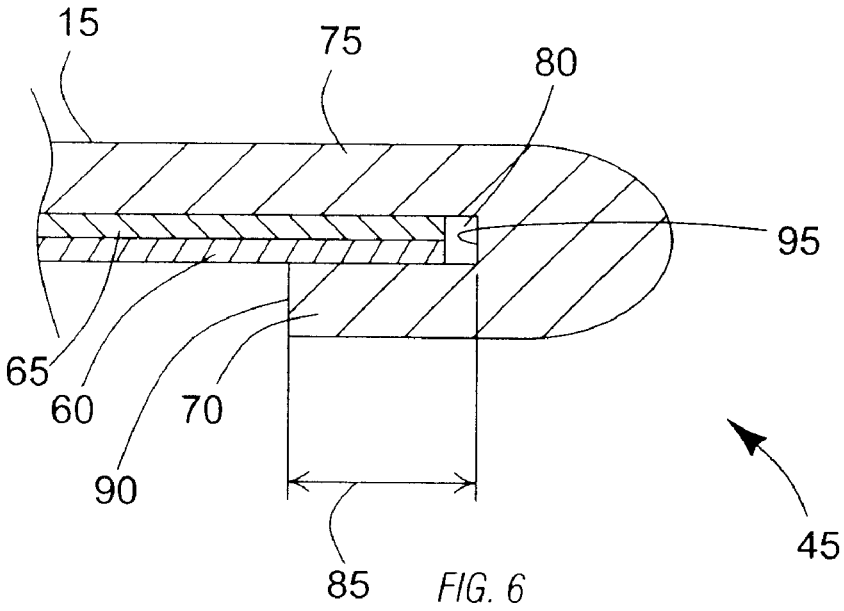
FIG. 6 is an enlarged section view of a lip portion taken along line 6-6 in FIG. 2.

With reference to FIG. 6, the lip edge 45 is shown in greater detail as including a top portion 70 and a panel portion 75. The top portion 70 is spaced a distance from the panel portion 75 to define a gap 80. The gap 80 is wide enough to receive at least the title sheet 65 and the cover sheet 60. The lip edge 45 can be formed as part of the front cover 15 of the binder 10 or can be attached after the front cover 15 is formed. In constructions in which the lip edge 45 is connected to the front cover 15, the lip edge 45 can be molded from a similar material as is used for the rest of the binder and the connection can be made using any suitable method (e.g., welding, adhesive, fasteners, and the like). While the lip edge 45 is shown as extending the entire height of the binder 10, other constructions may employ a lip edge 45 that is shorter than the binder 10 if desired.

Returning to FIG. 5, it can be seen that the lip edge 45 extends the full length of the binder 10 and defines a depth 85. While the actual depth 85 is not critical, it should be deep enough to retain the cover sheet 60 and title sheet 65 during normal binder use. As shown in FIG. 5, the depth 85 extends from a contoured edge 90 to a lip edge bottom 95 (shown in FIG. 6). As such, the depth 85 varies along the length of the lip edge 45. The contoured edge 90 includes an arcuate portion 100 near the center of the length. The arcuate portion 100 establishes an area having a small depth 85. The arcuate portion 100 cooperates with the cut-out portion 60*a* to allow the user to more easily insert and remove the cover sheet 60 for placement or removal of the title sheet 65. Those of ordinary skill in the art will understand that other contouring can be used for the contoured edge 90.

In use, the cover sheet 60 is pulled out from the lip edge 45 and opened to receive the title sheet 65, as shown in FIG. 3. The title sheet 65 is positioned as desired with at least a portion being positioned between the top portion 70 and the panel portion 75 of the lip edge 45, as shown in FIG. 6. The cover sheet 60 is then closed such that a portion of the cover sheet 60 also fits within the gap 80 adjacent the title sheet 65. In some constructions, the panel portion 75 and the front cover 15 cooperate to define one surface, while the top portion 70 defines a second surface with the title sheet 65 sandwiched between the two surfaces. In still other constructions, the front cover 15 alone defines the first surface such that the front cover 15 and the top portion 70 sandwich a portion of the title sheet 65.

Figure 7:
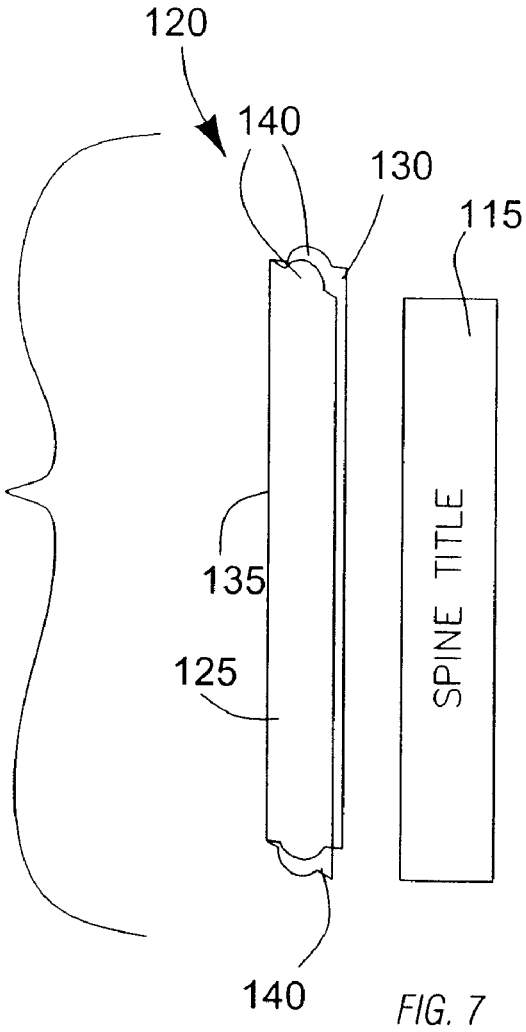
FIG. 7 is an end view of a label sleeve and a spine label.

To facilitate the insertion of a spine label 115, the molded binder 10 employs a label sleeve 120, as illustrated in FIG. 7. The label sleeve 120 is a relatively stiff piece of plastic having a front portion 125 and a rear portion 130, with at least a portion of the label sleeve 120 being translucent. The front portion 125 and rear portion 130 attach to each other along a hinge 135 that allows them to fold next to each other to form a substantially flat sheet. When folded, the spine label 115 disposed between the front and rear portions 125, 130 is protected and stiffened to facilitate easy installation and removal. In some constructions, different colored label sleeves 120 are employed to further aid in identifying the contents of the binder 10.

Figure 8:
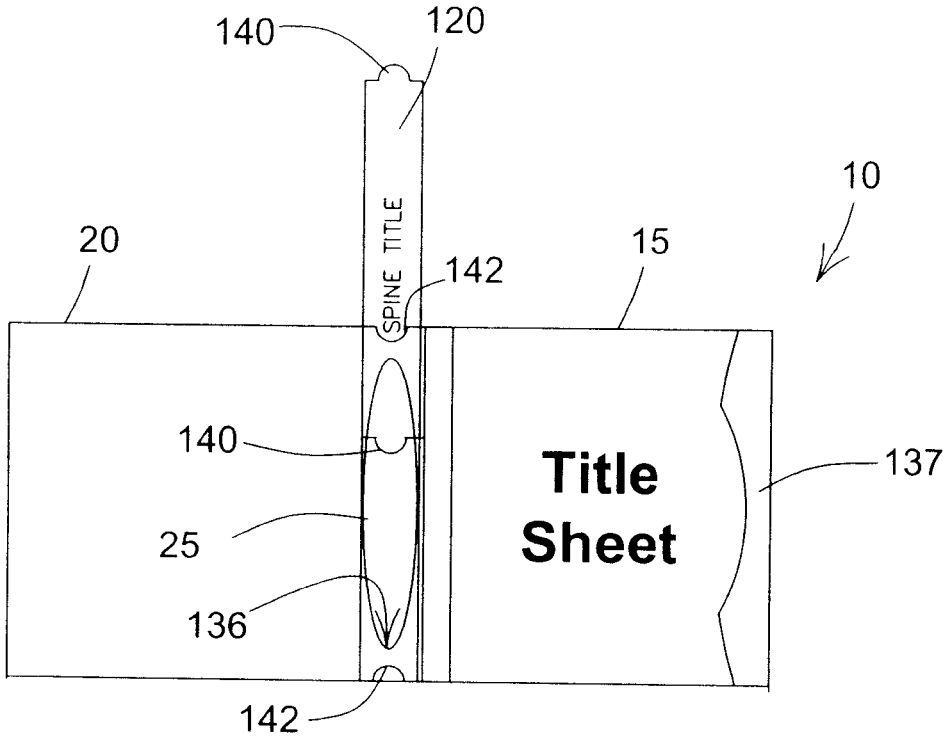
FIG. 8 is an end view of the label sleeve being inserted into a spine of a binder.

FIG. 8 illustrates the label sleeve 120 being inserted into the spine cavity 136 of the molded binder 10. The spine cavity 136 is formed by attaching a substantially rigid piece 137 to the spine 25 of the binder. In the illustrated embodiment, the substantially rigid piece 137 is at least partially formed from a molded plastic portion. Attachment can be made using any suitable method including welding, adhesives, fasteners, and the like. In other constructions, the molded plastic piece 137 is formed as part of the binder 10. The spine label 115 is positioned between the front portion 125 and rear portion 130 of the label sleeve 120.

In some constructions, the label sleeve 120 includes tabs 140 that extend above cut-outs 142 in the spine 25 to facilitate the easy removal of the label sleeve 120. Tabs 140 can be located on both ends or only one end as may be required by the particular binder.

Figure 9:
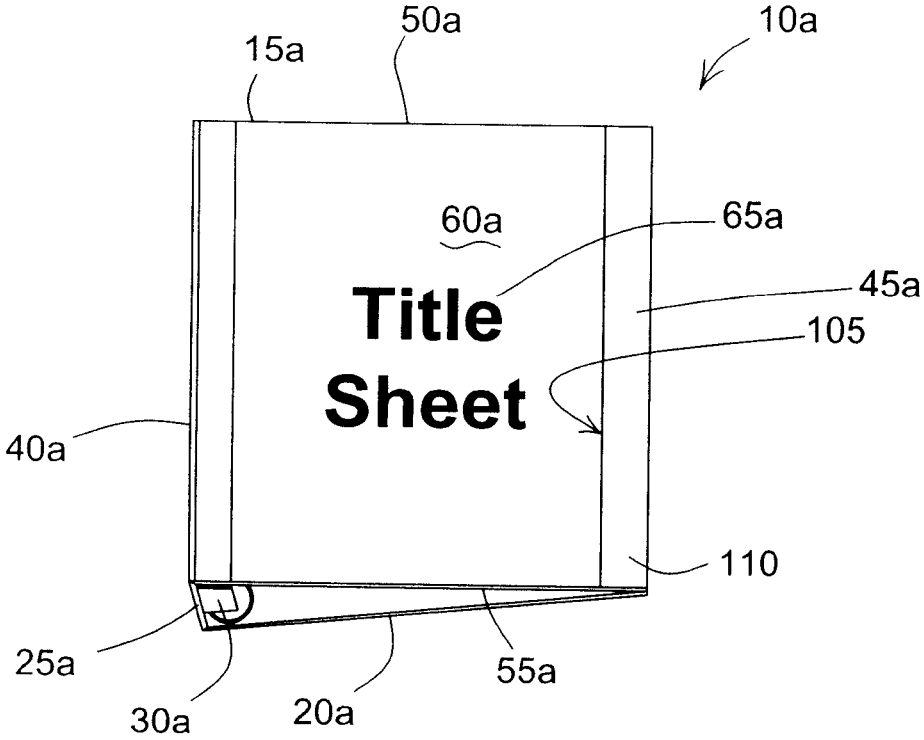
FIG. 9 is a perspective view of another ring binder with a cover sheet in a closed position.

Tuning to FIG. 9, a vinyl-covered binder 10*a* incorporating a cover sheet 60*a* is illustrated. The vinyl-covered binder 10*a* is similar to the molded binder 10 in many respects but is manufactured differently. Vinyl-covered binders 10*a* are generally manufactured by surrounding a relatively stiff material (e.g., cardboard, particle board, wood, plastic and the like) with vinyl or another plastic material. Thus, the binder structure is non-homogeneous. Like the molded binder 10, the vinyl-covered binder 10*a* includes a front cover 15*a*, a rear cover 20*a*, and a spine portion 25*a*. In addition, a ring mechanism 30*a* may be employed to capture paper inserted in the binder 10*a*. The ring mechanism 30*a*, if used, attaches to one or more of the front cover 15*a*, the rear cover 20*a*, or the binder spine 25*a*.

As with the molded binder 10, the front cover 15*a* of the vinyl-covered binder 10*a* defines a spine edge 40*a*, a top edge 50*a*, a bottom edge 55*a*, and a lip edge 45*a*. The cover sheet 60*a* attaches to the binder 10*a* adjacent the spine edge 40*a*. The cover sheet 60*a* can be formed as part of the vinyl cover, or can be attached separately using any suitable attachment method including, but not limited to adhesives, welding, fasteners, and the like. For example, one construction attaches the cover sheet 60*a* to the vinyl cover in two locations. First, the cover sheet 60*a* is inserted into a pocket such that it is positioned at least partially beneath the vinyl. The edge of the cover sheet 60*a* is welded to the vinyl adjacent the edge of the cover sheet. A second weld line is placed along the junction where the cover sheet 60*a* extends out from beneath the vinyl. In other constructions, only one of these weld locations is used. In still other constructions a jacket at least partially wraps around the binder cover and serves as an attachment point for the cover sheet 60*a*. Any of the foregoing attachment methods will also work well with these constructions.

Figure 10:
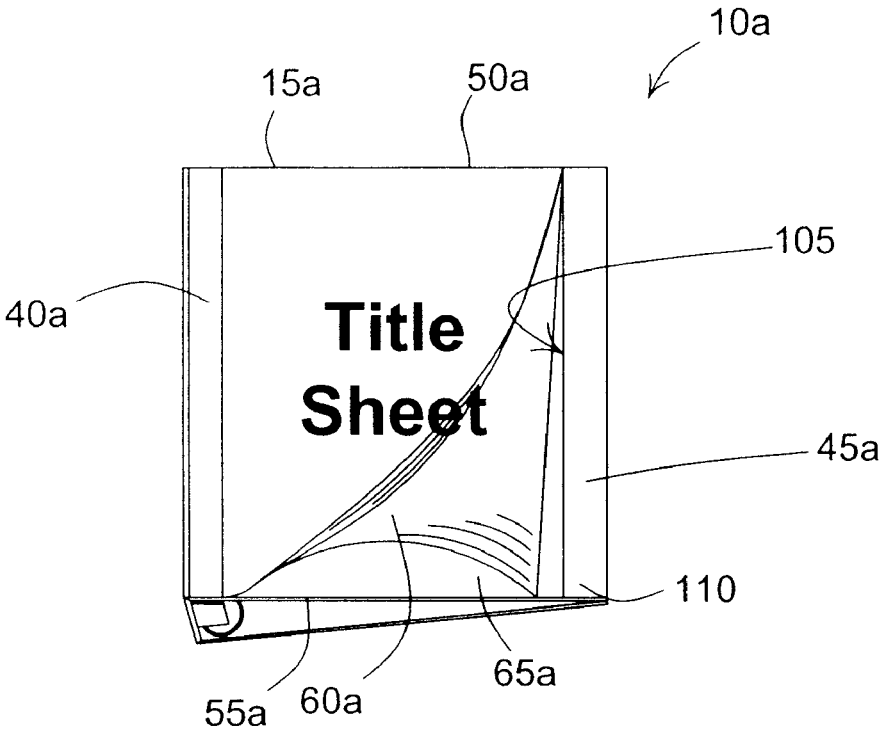
FIG. 10 is a perspective view of the binder of FIG. 9 as the cover sheet is moved between the closed position and an open position.
Figure 11:
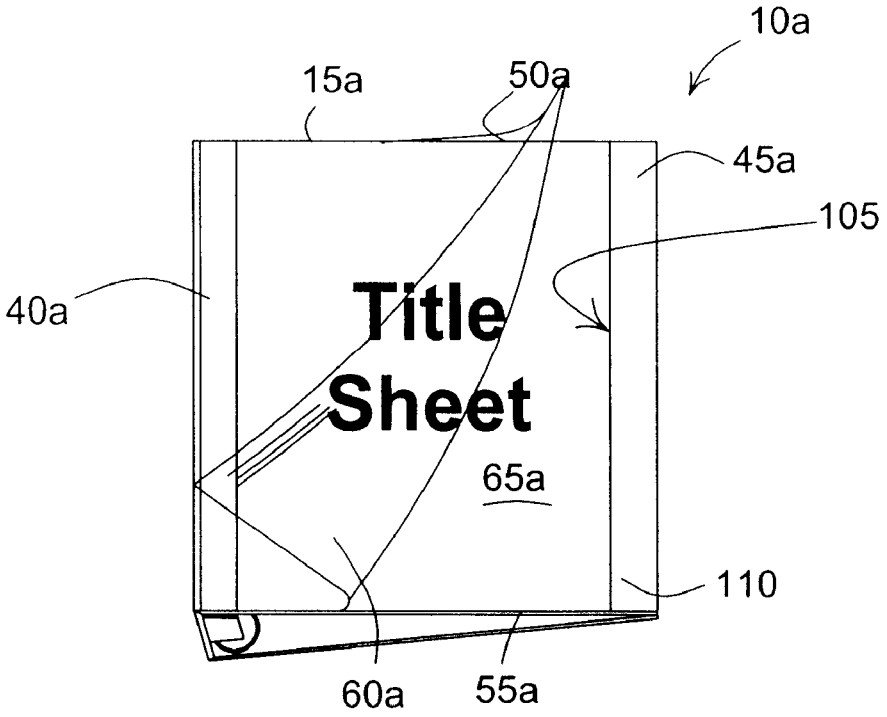
FIG. 11 is a perspective view of the binder of FIG. 9 with the cover sheet in the open position.

With the spine edge 40*a* attached, the three edges of the cover sheet 60*a* adjacent the top edge 50*a*, the bottom edge 55*a*, and the lip edge 45*a* of the front cover 15*a* remain free to move. This allows the cover sheet 60*a* to move between a closed position and an open position as illustrated in FIGS. 9-11. When in the closed position, the edge of the cover sheet 60*a* opposite the spine edge 40*a* engages a lip in the form of a pocket 105 that holds the cover sheet 60*a* in the closed position.

In one construction, a sheet of plastic 110 (e.g., vinyl), or a jacket, attaches to the front cover 15*a* to form the pocket 105. The attachment can be made in any suitable manner including, but not limited to welding, adhesives, fasteners, and the like. The pocket 105 is able to receive a portion of the title sheet 65*a* as well as a portion of the cover sheet 60*a* and retain them in the closed position. In another construction, a slit in the vinyl cover provides an opening that receives a portion of the title sheet 65*a* and the cover sheet 60*a* to hold them in the closed position.

Figure 13:
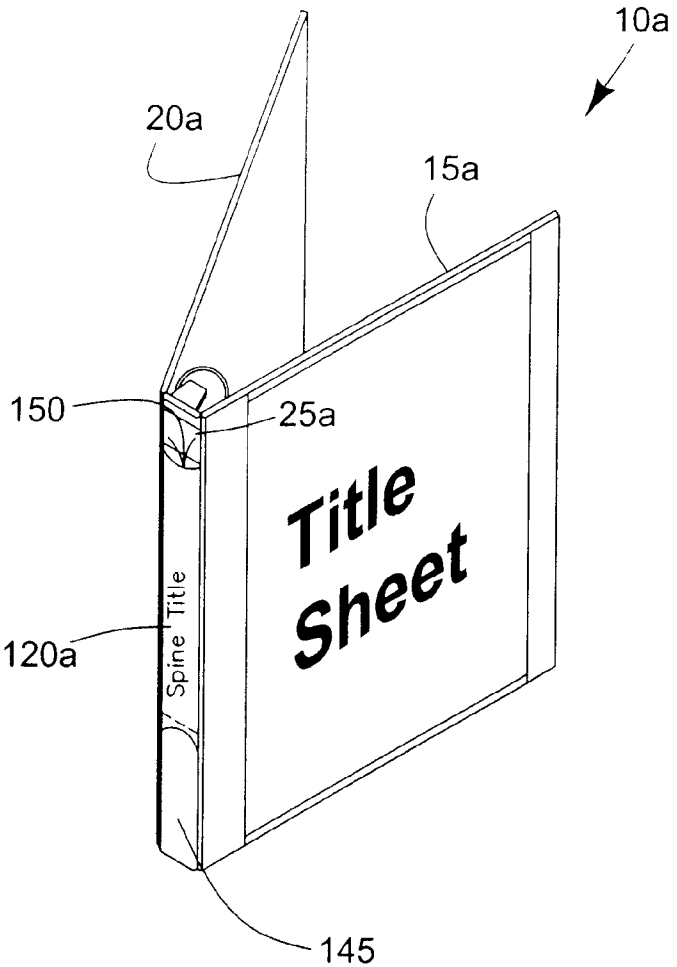
FIG. 13 is a perspective view of the binder of FIG. 12 including the label sleeve and spine label.
Figure 12:
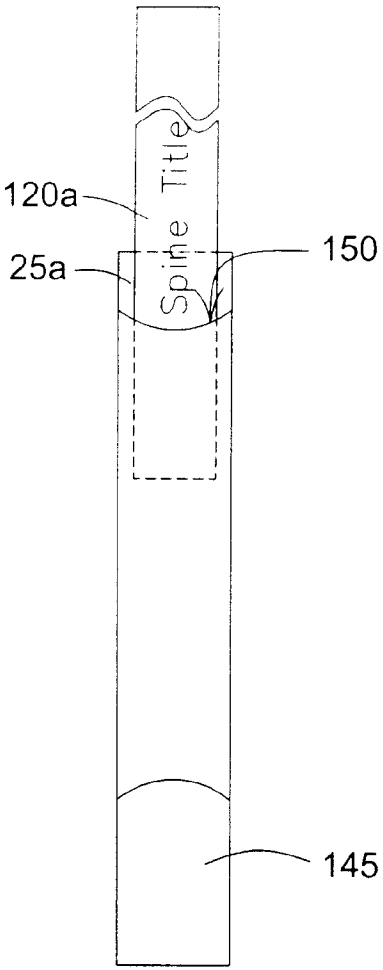
FIG. 12 is an end view of another label sleeve being inserted into a spine of another binder.

Turning to FIGS. 12 and 13, another label sleeve 120*a* (with inserted label) is shown being inserted into a spine cavity in a vinyl-covered binder 10*a*. In this construction, the vinyl cover, or an additional piece of vinyl secured over the vinyl cover 145 defines a spine pocket 150. The label sleeve 120*a* is inserted into the spine pocket 150 from either the top opening or the bottom opening. The label sleeve 120*a* can be pushed flat against the spine 25*a* to aid in its insertion into the spine pocket 150. Unlike the label sleeve 120 of FIG. 11, the label sleeve 120*a* illustrated in FIGS. 12-13 does not include tabs. However, other constructions of the label sleeve 120*a* may include tabs if desired.

In preferred constructions, the label sleeves 120, 120*a* are clear. However, other constructions include colored label sleeves. The colored label sleeves can be used to color code the binders and make it easier to pick a desired binder from a shelf based on the label sleeve color. In addition, label sleeves of different lengths or widths can be employed to accommodate different applications if desired.

The label sleeves 120, 120*a* make it much easier to insert and remove spine labels 115. The stiffness of the label sleeves 120, 120*a* provide the additional support needed to insert the long, narrow spine labels 115.

In addition, other spine treatments could be used to retain a label 115. For example, the tuckable cover sheet configuration similar to the one shown and described as being used on the front covers 15, 15*a* could be used on the spines 25, 25*a*.

Again, those of ordinary skill will realize that features described above can be applied to other DSDs and are not limited to use with binders. In addition, there are many different constructions for the present invention that will function to restrain a title sheet in a binder. FIGS. 14-34 illustrate a few of these possible constructions.

FIGS. 14-34 illustrate a variety of different DSDs in the form of binders 200. Before proceeding, it is important to note that the binders 200 illustrated in FIGS. 14-34 could be constructed as molded binders, vinyl-covered binders, or any other type of binders known in the binder art. As one of ordinary skill will realize, the actual construction of the binder is not critical to the function of the invention.

Figure 14:
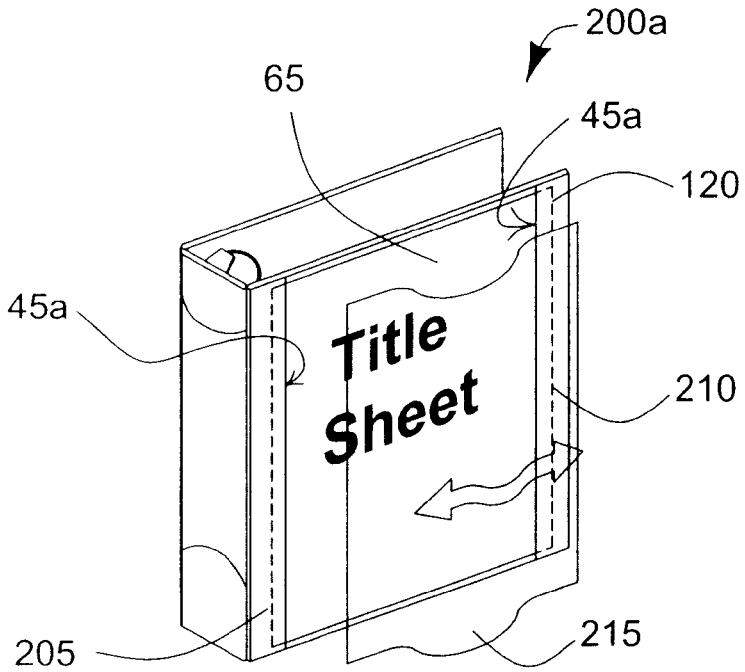
FIG. 14 is a perspective view of another construction of a binder including a cover sheet.

With reference to FIG. 14, a binder 200*a* is illustrated as including a spine-side pocket 205 and an edge pocket 210. The spine-side pocket 205 and the edge pocket 210 extend the full vertical height of the binder 200*a* and define lip edges 45*a* sized to receive the title sheet 65 and a loose cover sheet 215. The spine-side pocket 205 and the edge pocket 210 attach to the binder 200*a* using any suitable means. For example, in one construction, three edges of each pocket 205, 210 are welded to the cover of the binder 200*a*. In another construction, the pockets 205, 210 slide over the binder cover and are welded on the inside portion of the cover.

In some constructions, the binder 200*a* includes a top lip 66 and/or a bottom lip 67 (shown in FIG. 1) that hold the title sheet 65 and inhibit movement vertically. In other constructions, the pockets 205, 210 are formed to perform this function and inhibit movement of the title sheet 65 and the cover sheet 215 in the vertical direction.

To insert the title sheet 65, the user first tucks one of the vertical edges into the spine-side pocket 205 or the edge pocket 210 and then tucks the opposite edge into the remaining pocket 205, 210. The translucent cover sheet 215 is inserted in a similar manner. The pockets 205, 210 are sized and positioned to maintain the title sheet 65 and the cover sheet 215 in position during use of the binder.

Figure 15:
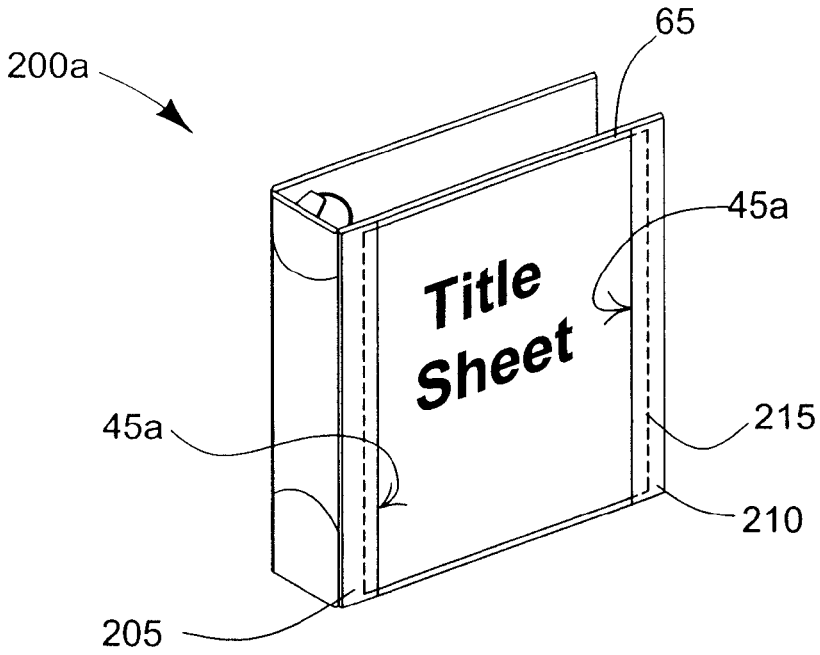
FIG. 15 is a perspective view of another construction of a binder including a cover sheet.

FIG. 15 shows the binder 200*a* of FIG. 14 with the title sheet 65 and the cover sheet 215 in their tucked positions. While the construction of FIG. 15 illustrates the spine-side pocket 205 and the edge pocket 210 as being translucent, other constructions incorporate opaque pockets 205, 210.

Figure 16:
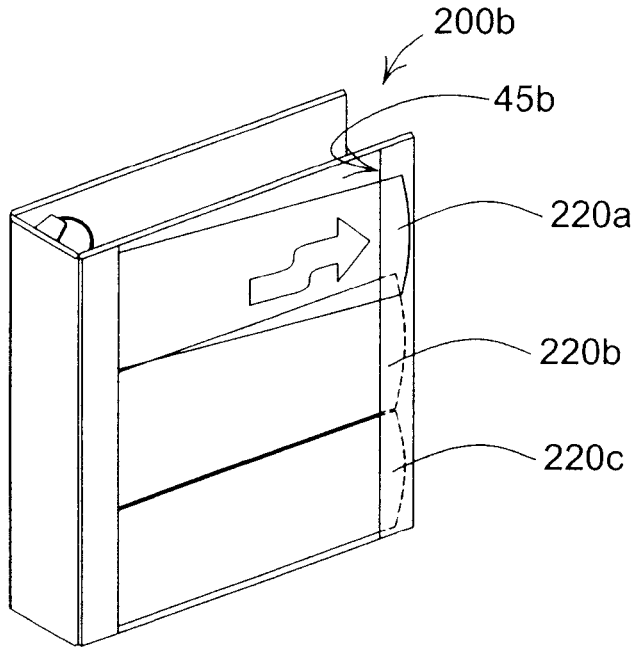
FIG. 16 is a perspective view of yet another construction of a binder including a cover sheet.

FIG. 16 illustrates a binder 200*b* similar to that of FIGS. 1-9 with the exception that the cover sheet is defined by multiple separate cover sheet segments 220*a*, 220*b*, 220*c*. FIG. 16 illustrates three segments 220*a*, 220*b*, 220*c* with other constructions using two segments and still others using four or more segments. Each of the cover sheet segments 220*a*, 220*b*, 220*c* is attached to the binder in a manner similar to that described with regard to the cover sheets 60 of FIGS. 1-9. In addition, each cover sheet segment 220*a*, 220*b*, 220*c* tucks beneath a lip edge 45*b* to secure the cover sheet segment 220*a*, 220*b*, 220*c* in place. In some constructions, multiple lip edges are provided for the multiple cover sheet segments. For example, three lip edges could be provided to capture the three cover sheet segments illustrated in FIG. 16. The three lip edges could be separated to define three separate pockets. Of course there is no requirement that there be a one-to-one correspondence between the number of cover sheet segments and lip edges.

The use of multiple cover sheet segments 220*a*, 220*b*, 220*c* allows for the use of multiple colors, patterns, or textures if desired. In addition, multiple title sheet segments can be positioned under the individual cover sheet segments 220*a*, 220*b*, 220*c* if desired.

Figure 17:
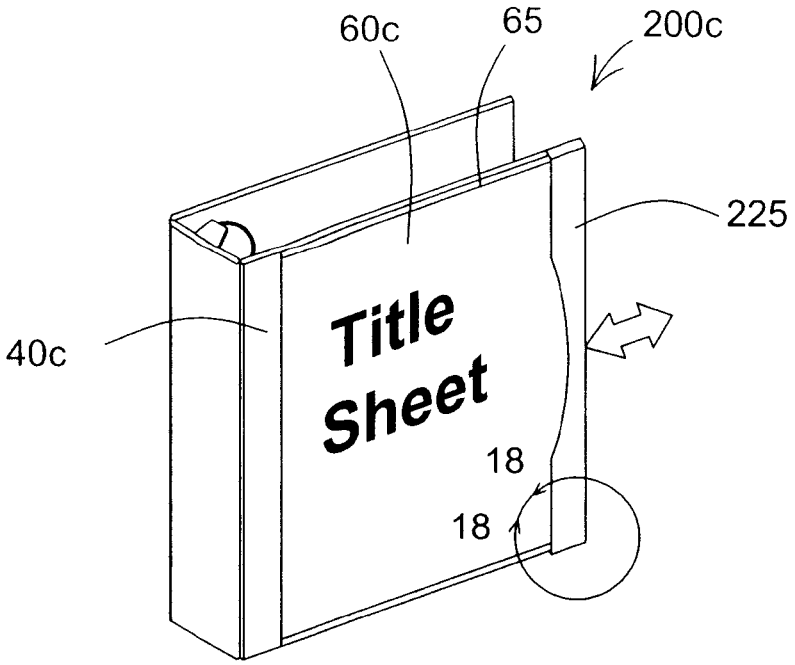
FIG. 17 is a perspective view of still another construction of a binder including a cover sheet.
Figure 18:
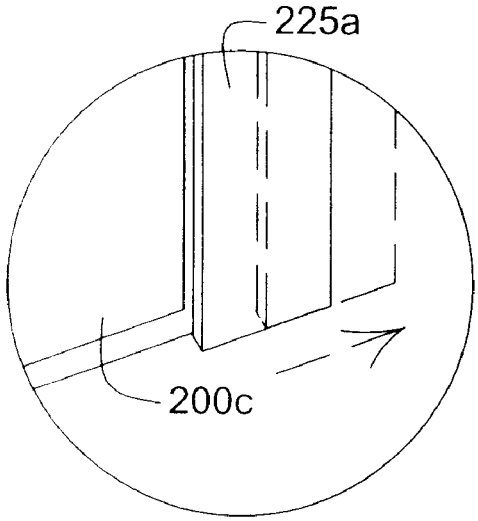
FIG. 18 is an enlarged perspective view of the binder of FIG. 17 taken along line 18-18 and showing one construction of a movable lip.
Figure 19:
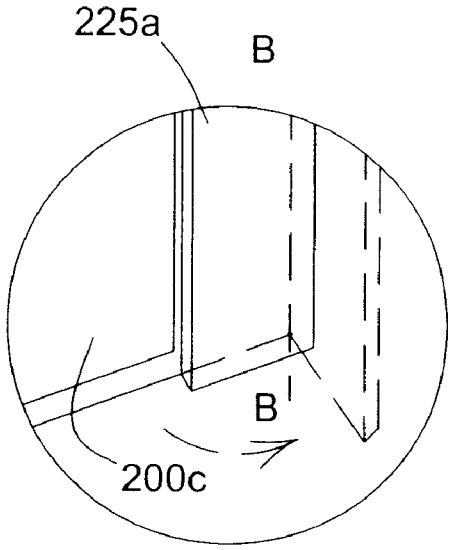
FIG. 19 is an enlarged perspective view of the binder of FIG. 17 taken along line 18-18 and showing another construction of a movable lip.

FIGS. 17-19 illustrate yet another construction of a binder 200*c* in which a lip edge 225 is movably attached to the binder 200*c*. The binder includes a translucent cover sheet 60*c* that is attached to the binder 200*c* along a spine edge 40*c* in a manner that has been described. The remaining three edges remain free. The lip edge opposite the spine edge 40*c*, tucks under the movable lip edge 225.

FIG. 18 shows one construction of the binder 200*c* of FIG. 17 in which the movable lip edge 225 translates in a plane substantially parallel to the binder cover. In another construction, illustrated in FIG. 19, the lip edge 225*a* pivots about an axis B-B that is parallel to the binder cover.

The movable lip edge 225 allows for the use of stiffer or thicker materials to make up the cover sheet 60*c* or the title sheet 65. The stiffer materials are not easily bent, thereby making them difficult to tuck. By providing a movable lip edge 225, the cover sheet 60*c* can be positioned as desired with the lip edge 225 in an open position. The lip edge 225 is then moved to a closed position to retain the title sheet 65 and the cover sheet 60*c*.

Figure 20:
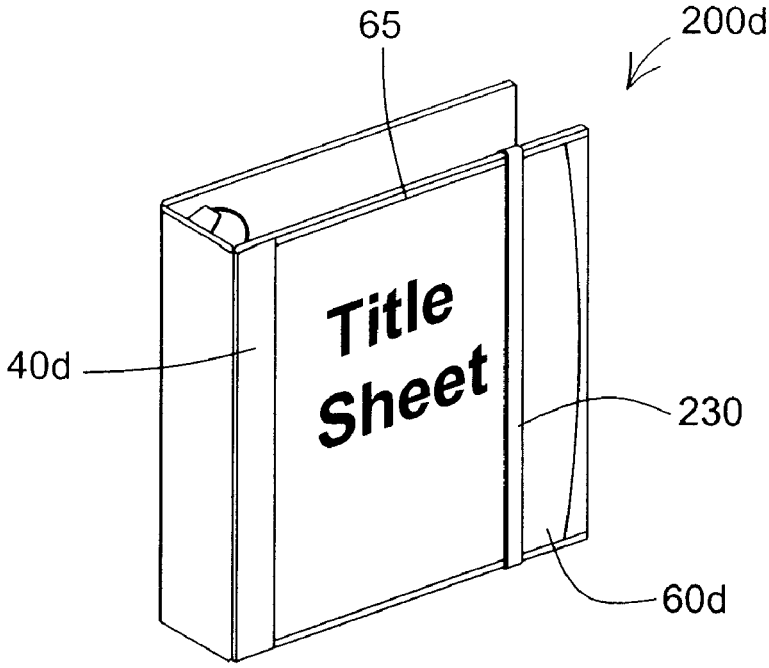
FIG. 20 is a perspective view of another construction of a binder including a cover sheet.

With reference to FIG. 20, yet another construction of a binder 200*d* is illustrated. The binder 200*d* includes a resilient member 230 such as a bungee or a rubber band that can be positioned to retain the cover sheet 60*d* and the title sheet 65 in a desired position. The resilient member 230 attaches to the inner surface of the binder 200*d* and can be positioned as illustrated in FIG. 20. The cover sheet 60*d* attaches to the binder 200*d* as has been previously described, with the resilient member acting to restrain the free edge of the cover sheet 60*d* opposite a binder spine edge 40*d*. It should be noted that the resilient member can attach to any surface of the binder desired with the inner surface generally being the most convenient.

Figure 21:
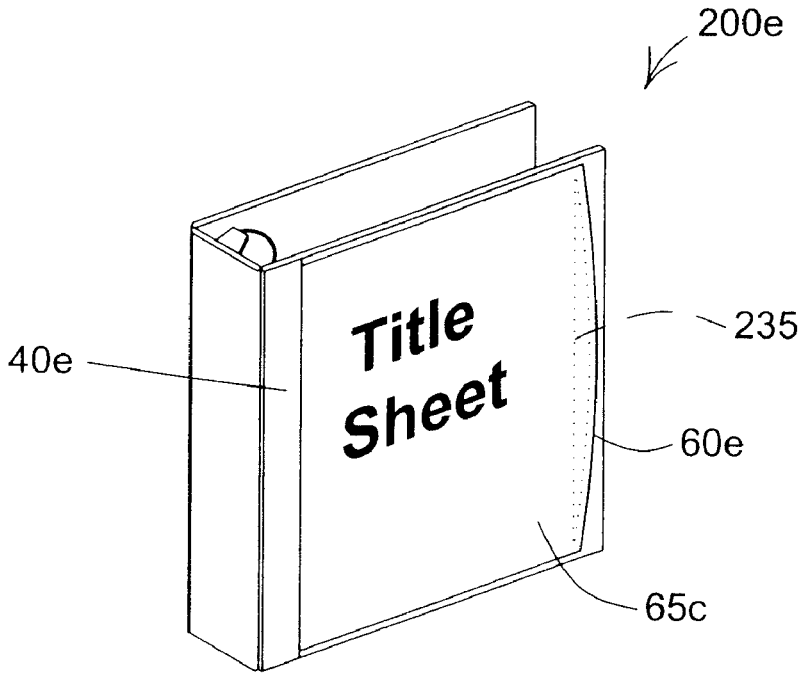
FIG. 21 is a perspective view of yet another construction of a binder including a cover sheet.

FIG. 21 illustrates another construction of a binder 200*e* having a cover sheet 60*e*. The cover sheet 60*e* attaches to the binder 200*e* along a spine edge 40*e* in much the same way as was described with regard to FIGS. 1-9. In addition, the binder 200*e* of FIG. 21 is similar to either of the binders 10, 10*a* described with reference to FIGS. 1-9 with the exception that no lip edge is provided. Rather, the binder 200*e* of FIG. 21 includes an adhesive strip 235 positioned along the edge opposite the spine 40*e*. The adhesive strip 235 engages and holds the cover sheet 60*e* in the closed position. While a permanent adhesive could be used, preferred constructions include a reusable adhesive that allows for the multiple openings and closings of the cover sheet 60*e*. The term "adhesive" as used within this application should be read broadly to include other fastening means such as, but not limited to, Velcro, snaps, hooks, buttons, and the like.

Figure 22:
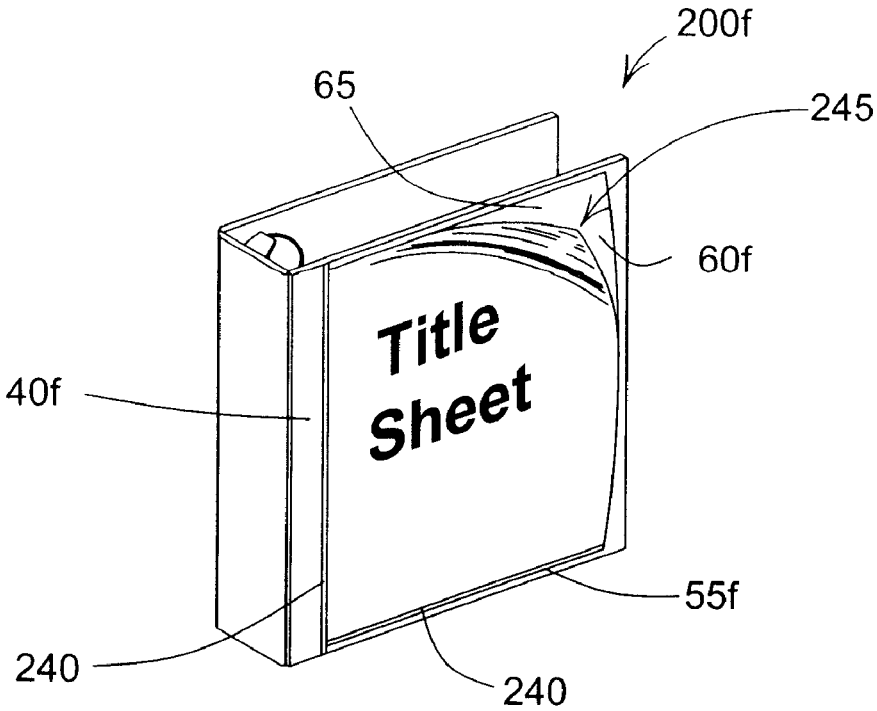
FIG. 22 is a perspective view of still another construction of a binder including a cover sheet.

Turning to FIG. 22, another binder 200*f* including a movable cover sheet 60*f* is illustrated. The translucent cover sheet 60*f* is attached to the binder along two intersecting attachment edges 240. As illustrated in FIG. 22, the cover sheet 60*f* is attached adjacent a spine edge 40*f*, and a bottom edge 55*f* of the binder 200*f* to define a pocket 245 for receiving the title sheet 65. In some constructions, the corner opposite the corner defined by the intersection of the attached edges 40*f*, 55*f* (the free corner) tucks beneath a lip to restrain the loose corner of the cover sheet 60*f*. In still other constructions, an adhesive portion is positioned adjacent the free corner to hold the corner of the cover sheet 60*f* in place.

Figure 23:
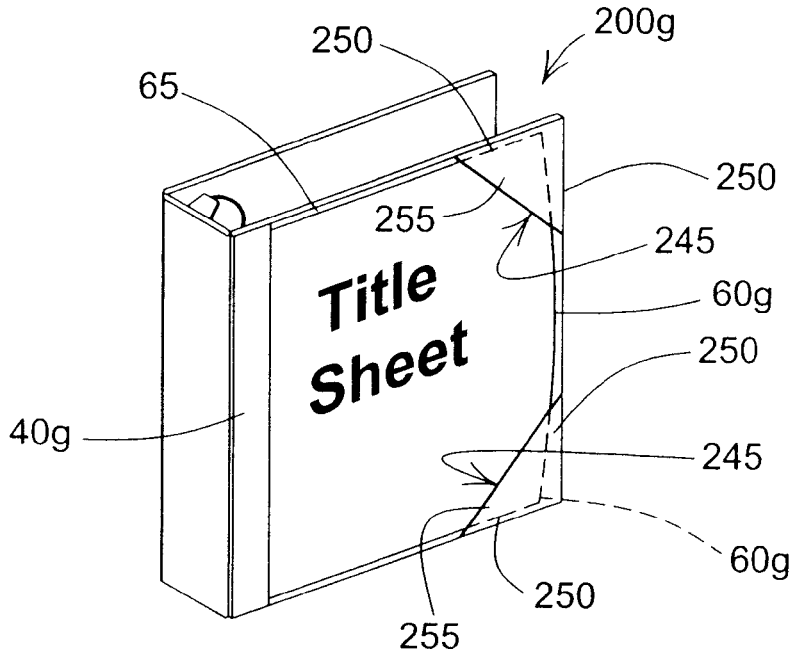
FIG. 23 is a perspective view of another construction of a binder including a cover sheet.

With reference to FIG. 23, another construction of a binder 200*g* is illustrated as including a cover sheet 60*g* attached to the binder 200*g* along a spine edge 40*g* in much the same manner as was described with regard to FIGS. 1-9. Rather than providing a lip edge, the binder 200*g* includes two corner pockets 245 that engage the corner of the title sheet 65 and the cover sheet 60*g* to hold them in position. Attaching two edges 250 of a triangular piece 255 to the binder 200*g* forms each pocket 245. In other constructions, the corner pockets 245 slide over the corner of the binder 200*g* and are welded to the inside portion of the cover to attach the pockets 245 to the binder 200*g*.

Figure 24:
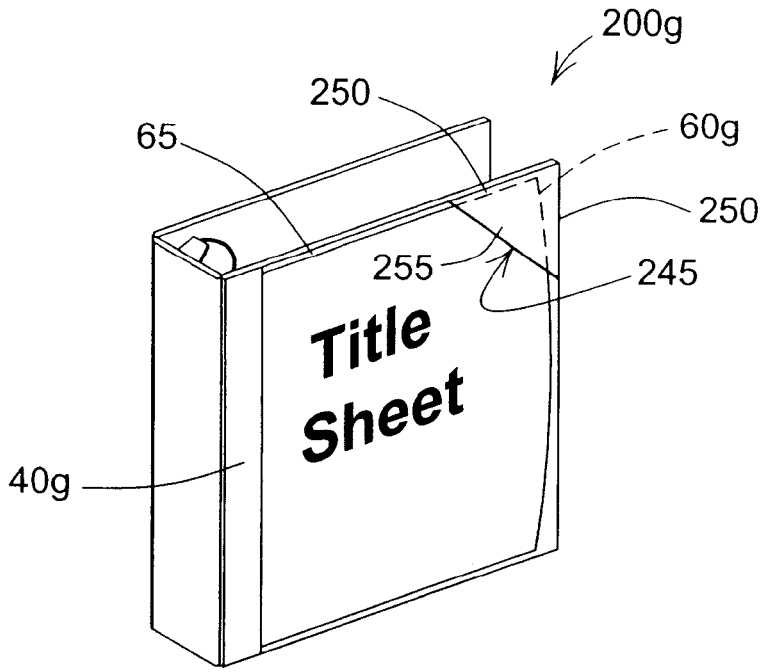
FIG. 24 is a perspective view of yet another construction of a binder including a cover sheet.

In another construction, illustrated in FIG. 24, a single corner pocket 245 is used. The single pocket 245 can be positioned adjacent the top corner as illustrated, or alternatively, the corner pocket 245 can be positioned adjacent the bottom corner.

Figure 25:
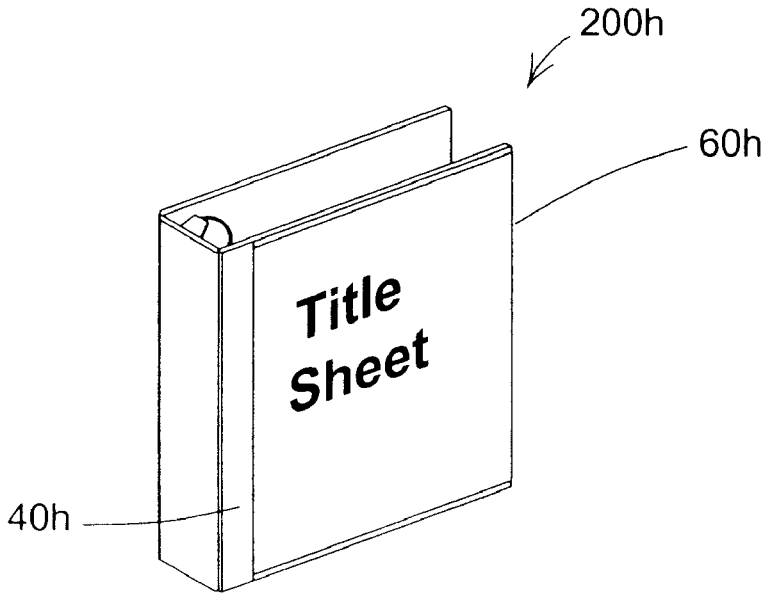
FIG. 25 is a perspective view of still another construction of a binder including a cover sheet.
Figure 26:
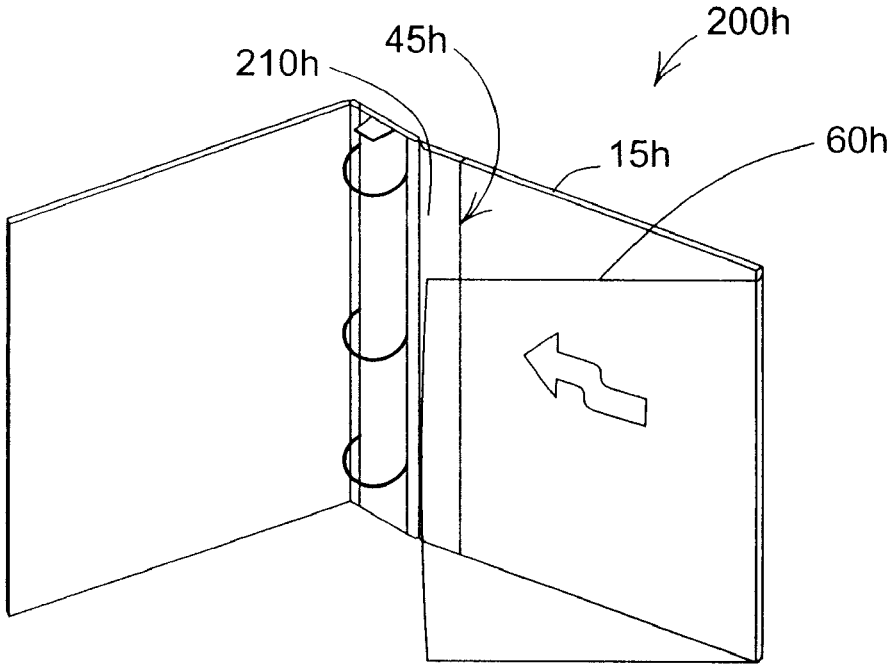
FIG. 26 is another perspective view of the binder of FIG. 25.

FIGS. 25 and 26 illustrate yet another construction of a binder 200*h* in which the cover sheet 60*h* attaches to a cover 15*h* of the binder 200*h* adjacent a spine edge 40*h* as has been previously described. However, the cover sheet 60*h* wraps around the cover 15*h* of the binder 200*h* and tucks into a lip edge 45*h* defined on the inner surface of the binder 200*h*. The lip edge 45*h*, in the construction of FIG. 26, includes a pocket 210*h* having three edges welded to the binder 200*h* and a fourth edge open to receive the cover sheet 60*h*. In other constructions, the lip edge 45*h* is formed as part of the binder 200*h* rather than being a separate piece that attaches to the binder 200*h*.

Figure 27:
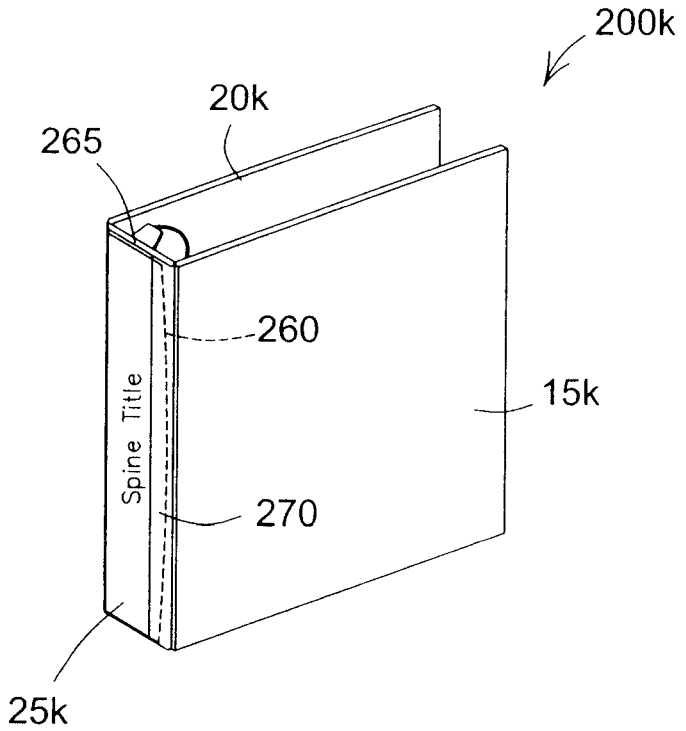
FIG. 27 is a perspective view of another construction of a binder including a spine cover sheet.

FIG. 27 illustrates a binder 200*k* that includes a tuckable cover sheet 260 positioned to hold a spine title page 265. The tuckable sheet 260 attaches to the spine 25*k* or to one of the binder covers 15*k*, 20*k*, adjacent one of the long edges of the spine 25*k*. The opposite long edge includes a spine lip 270 that is similar to the lip edge 45 described herein. The spine lip 270 engages the free edge of the spine cover sheet 260 along with one edge of the spine title page 265 to restrain the two in the desired position.

Figure 28:
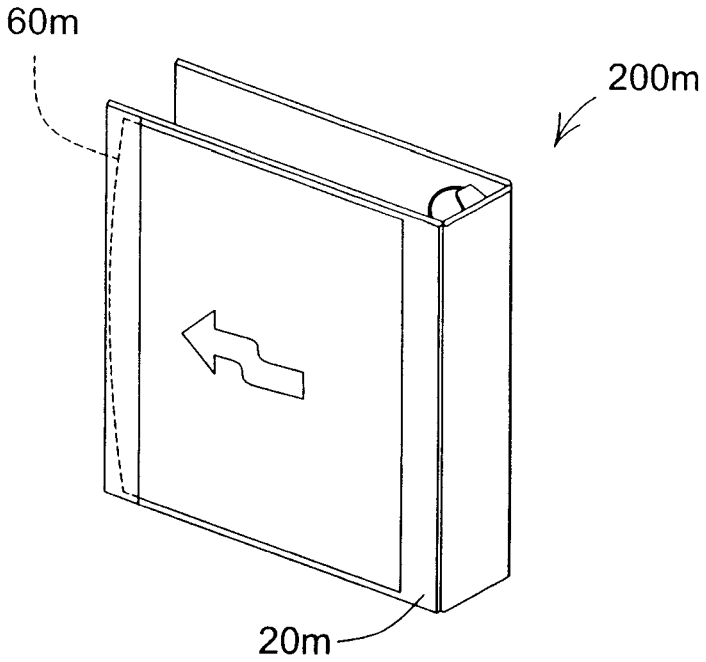
FIG. 28 is a perspective view of another construction of a binder including a rear cover sheet.
Figure 29:
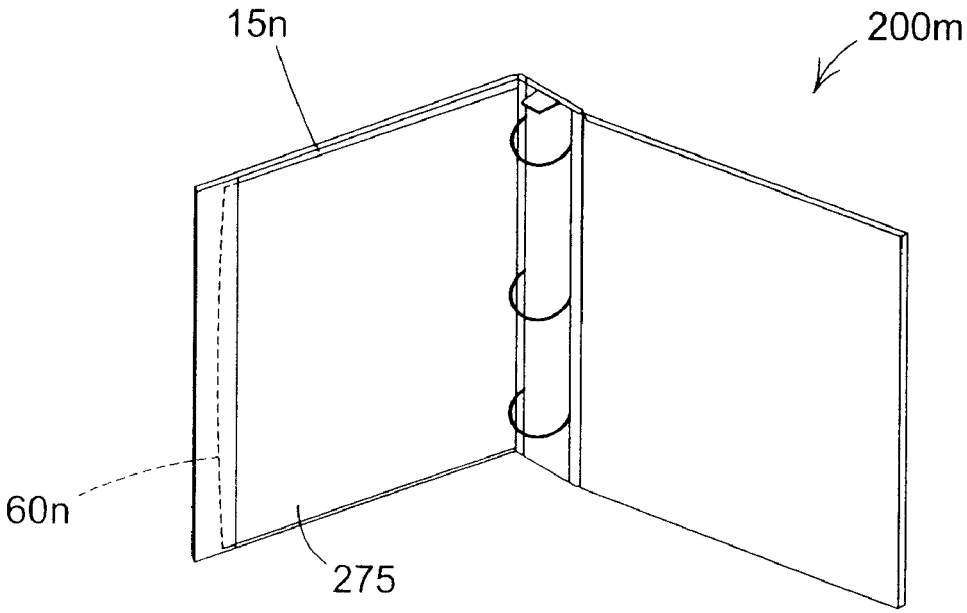
FIG. 29 is a perspective view of another construction of a binder including an interior cover sheet.

It should be clear to one of ordinary skill that the covers 60, 215, 220, 260 described herein could be applied to any surface of the binder. FIGS. 28 and 29 illustrate two examples of this. FIG. 28 illustrates a cover sheet 60*m* positioned on a rear cover 20*m* of a binder 200*m*, while FIG. 29 illustrates a cover sheet 60*n* positioned on an inside surface 275 of a binder 200*n* front cover 15*n*. It should be clear that virtually any one of the constructions described herein could be applied to any substantially planar surface of the binder with little or no modifications being required. As such, the invention should not be limited to applications that include the front cover of the binder alone.

Figure 30:
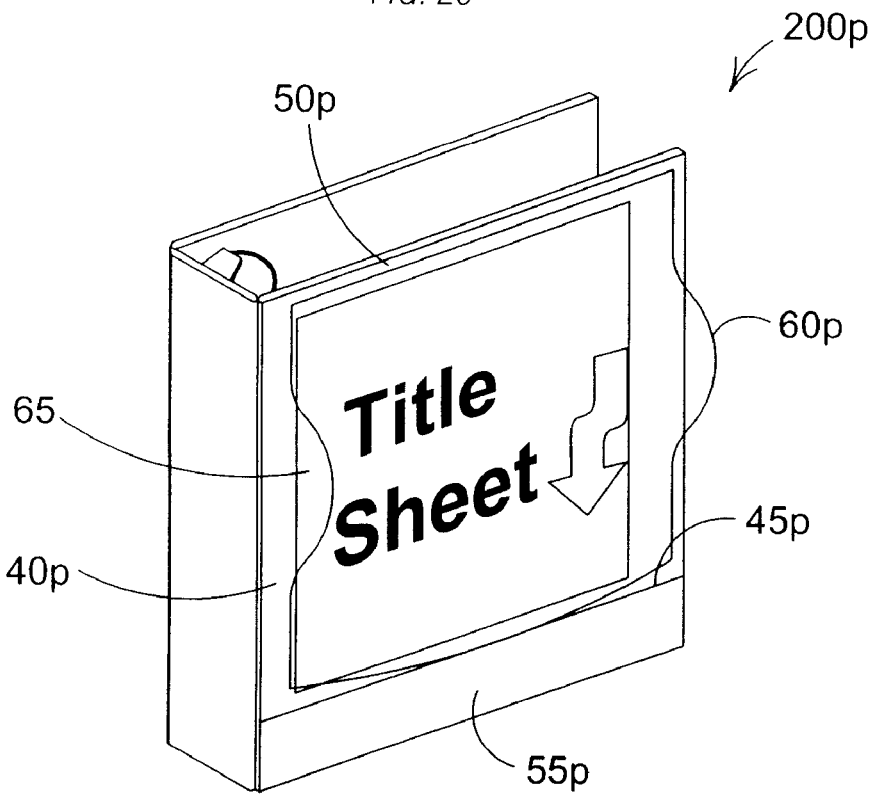
FIG. 30 is a perspective view of another construction of a binder including a cover sheet.

Turning to FIG. 30, another binder 200*p* is illustrated as including a cover sheet 60*p* attached to the binder adjacent a top edge 50*p* rather than a spine edge 40*p*. The remaining three edges of the cover sheet 60*p* remain free to move. A lip edge 45*p* is positioned adjacent a bottom edge 55*p* of the binder 200*p* to engage the free edge of the cover sheet 60*p* and hold the title sheet 65 and the cover sheet 60*p* in place. The lip edge 45*p* is similar to the lip edges already described.

It should be clear that a cover sheet can be attached to a binder adjacent any edge of the binder. In addition, any of the remaining free edges of the cover sheet can engage a lip edge and hold the cover sheet as desired, with the opposite edge being preferred. As such, the invention should not be limited to the orientations described herein.

Figure 31:
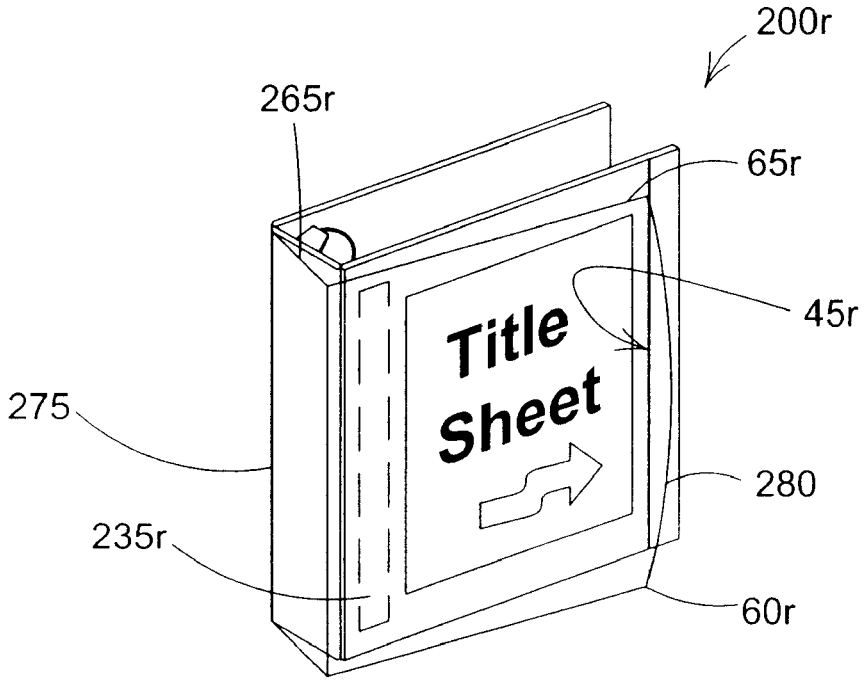
FIG. 31 is a perspective view of yet another construction of a binder including a cover sheet.

FIG. 31 illustrates another construction of a binder 200*r* that includes a cover sheet 60*r* that functions to cover a spine title page 265*r* as well as a title sheet 65*r*. The cover sheet 60*r* attaches to the binder 200*r* adjacent a rear vertical edge 275 of the binder 200*r* and wraps around the front of the binder 200*r* where a free end 280 engages a lip edge 45*r* similar to those already described. The cover sheet 60*r* can be attached to the binder 200*r* on the spine side of the vertical edge 275 or on the rear cover side of the edge 275 as desired. In some constructions, a top edge lip and/or a bottom edge lip (similar to that of FIG. 1) are provided on one or both of the spine and the front cover to inhibit undesirable vertical movement of the spine title page 265*r* and the title sheet 65*r*.

Before proceeding, it should be noted that one or both of a top edge lip and a bottom edge lip could be applied to any construction of the binder to inhibit undesirable vertical movement of the spine title page or the title page if desired.

The binder 200*r* may also include a strip of adhesive 235*r* adjacent the front vertical edge of the spine. The adhesive engages the cover sheet 60*r*, thereby allowing the cover sheet 60*r* to tightly cover the spine without slipping and disengaging from the lip edge 45*r*.

Figure 32:
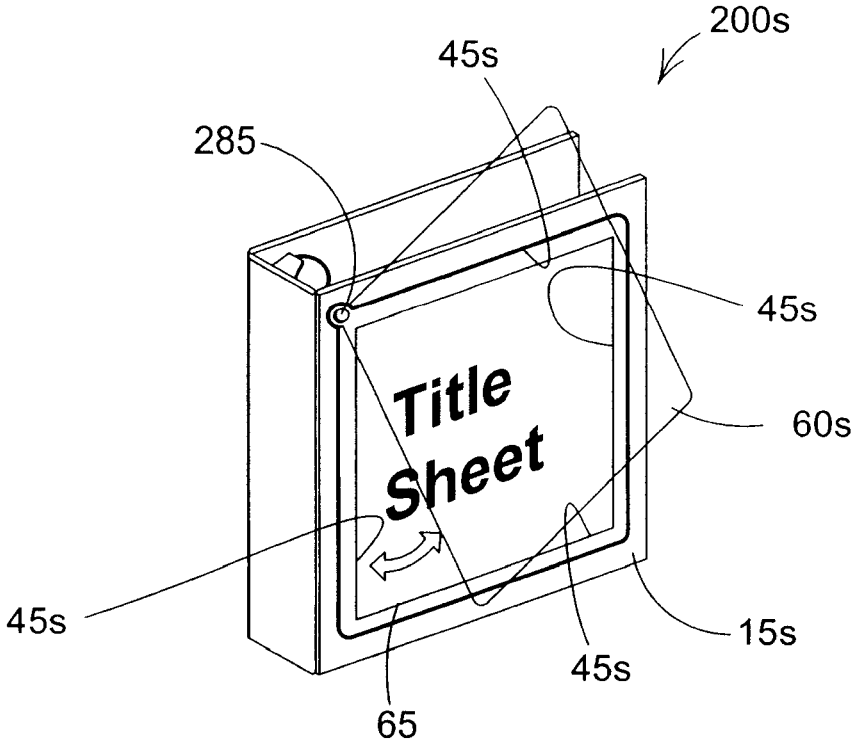
FIG. 32 is a perspective view of still another construction of a binder including a pivotable cover sheet.

FIG. 32 illustrates another construction of a binder 200*s* that includes a cover sheet 60*s*. A pin 285 attaches the cover sheet 60*s* to the front of the binder 200*s* so that the cover sheet 60*s* is pivotable about an axis. The cover sheet 60*s* covers a title sheet 65 that is positioned on a binder cover 15*s*. A lip edge 45*s* extends around the perimeter of the binder cover 15*s* in a position that facilitates the engagement of the edges of the cover sheet 60*s* with the lip edges 45*s*. In other constructions, only portions of the perimeter include lip edges 45*s*.

Figure 34:
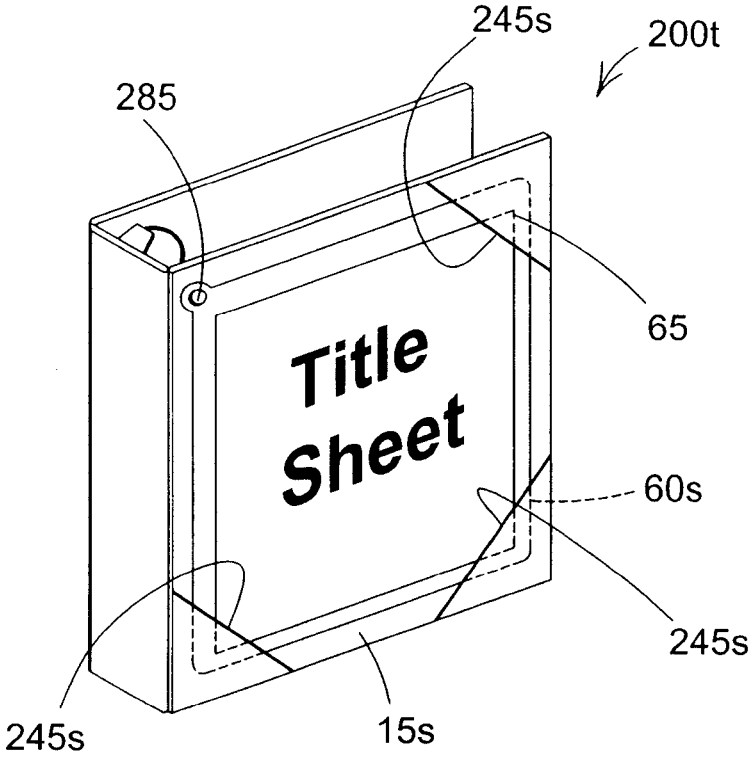
FIG. 34 is a perspective view of still another construction of a binder including a pivotable cover sheet.

In yet another construction, one or more corner pockets 245*s* is used to hold the cover sheet 60*s* in position. FIG. 34 illustrates a construction that includes three corner pockets 245*s*. Each corner pocket 245*s* attaches to the binder and functions in a manner similar to that already described.

Figure 33:
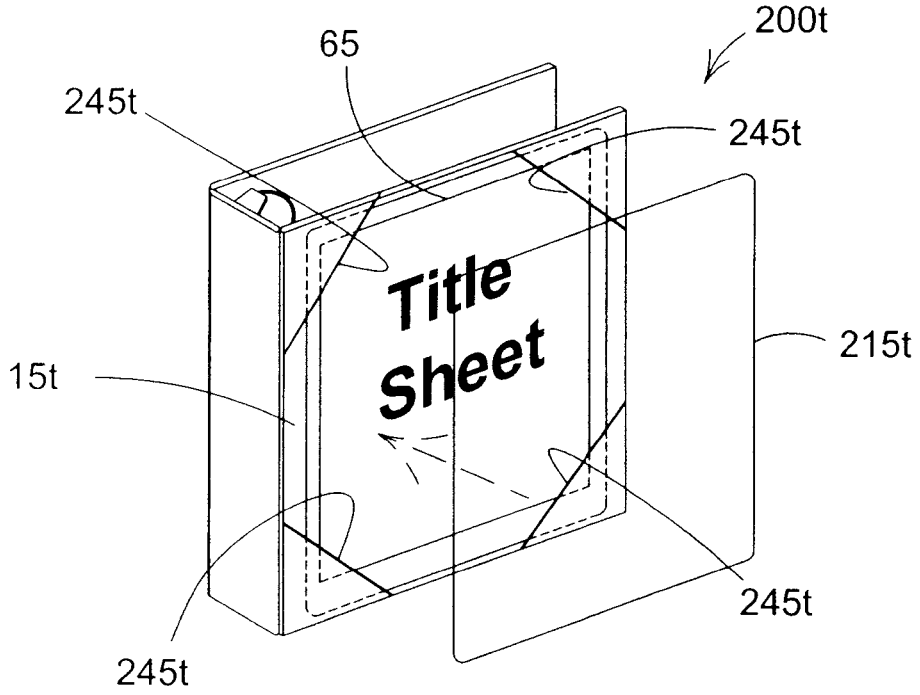
FIG. 33 is a perspective view of another construction of a binder including a cover sheet.

FIG. 33 illustrates another construction of a binder 200*t* in which a cover sheet 215*t* is not permanently attached to the binder 200*t*. The cover sheet 215*t* engages four corner pockets 245*t* to cover a title sheet 65 positioned on a binder cover 15*t*. In other constructions, three corner pockets 245*t*, or even two corner pockets 245*t* are used to hold the cover sheet 215*t*. In still other constructions, a lip edge in combination with one or more corner pockets 245*t* holds the cover sheet 215*t* in place.

Figure 36:
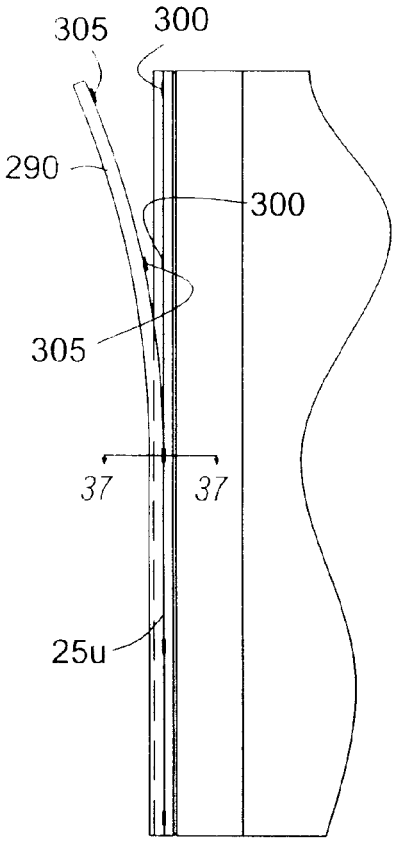
FIG. 36 is an enlarged perspective view of the binder of FIG. 35 with the retainer partially removed.
Figure 35:
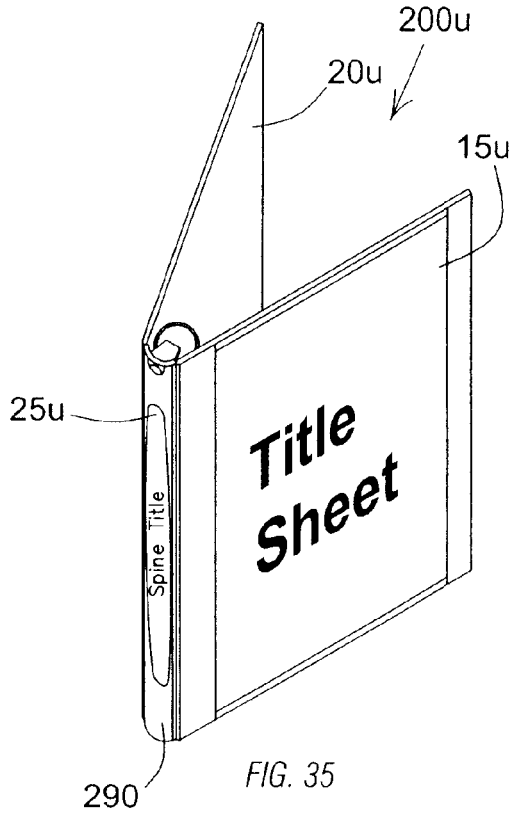
FIG. 35 is a perspective view of another construction of a binder including a retainer.
Figure 37:
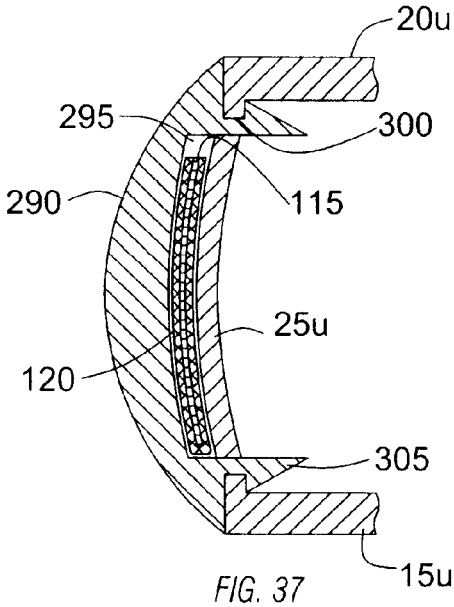
FIG. 37 is a section view of the binder of FIG. 35 taken along line 37-37 of FIG. 36.

Turning to FIGS. 35-37 another construction of a binder 200*u* is illustrated. The hinder 200*u* includes a cover that defines a front panel 15*u*, a rear panel 20*u*, and a spine 25*u*. The binder 200*u* also includes a retainer 290 that attaches to at least one of the front panel 15*u*, the rear panel 20*u*, and the spine 25*u* to define a pocket 295. In the construction illustrated in FIG. 35, the retainer 290 attaches to the spine 25*u*. However, it should be understood that retainers 290 could be made to attach to any surface of the binder 200*u*.

The binder 200*u* includes a plurality of binder attachment members in the form slots 300, while the retainer 290 includes a plurality of retainer attachment members in the form of tabs or hooks 305. The hooks 305 align with and engage the slots 300 to define snap-fits and allow for the removable attachment of the retainer 290 to the spine 25*u*.

When the retainer 290 is attached to the spine 25*u*, the retainer 290 and spine 25*u* cooperate to define the pocket 295. The pocket 295 is sized to receive a spine label 115 disposed in a label sleeve 120 similar to those illustrated in FIGS. 10 and 11. In other constructions, the pocket 295 can be sized to hold other items. For example, one construction includes a retainer that cooperates with the cover to define a pocket sized to retain a plurality of business cards. It should be clear that the pocket 295 can be sized to hold a variety of items. As such, the pocket 295 should not be limited to the few examples discussed.

Although the invention has been described in detail with reference to certain preferred embodiments, variations and modifications exist within the scope and spirit of the invention as described and defined in the following claims.

What is claimed is:

1. A document storage device configured to receive a spine label, the document storage device comprising:

a spine;

a spine cover cooperating with the spine to define a pocket; and a sleeve member operable to at least partially surround the spine label to define a removable spine insert that is inserted into the pocket, the sleeve member including a first portion and a second portion connected along a hinge, with the spine label positioned between the first and second portions, the sleeve member remaining in the pocket with the spine label and removable from the pocket in a direction parallel to the hinge to remove the spine label, wherein the sleeve member is formed from a translucent material.

2. The document storage device of claim 1, wherein the sleeve member has a substantially constant width.

3. The document storage device of claim 1, wherein the sleeve member includes a tab at an end to facilitate removal of the spine insert from the pocket.

4. The document storage device of claim 3, wherein the spine cover includes a cut-out, and wherein the tab is positioned at the cut-out when the sleeve member is inserted in the pocket to facilitate grasping the tab.

5. The document storage device of claim 3, wherein the sleeve member includes opposite ends and a tab at each of the opposite ends.

6. The document storage device of claim 1, wherein the spine cover is welded to the binder.

7. The document storage device of claim 1, wherein the spine cover and the spine cooperate to define a snap-fit to attach the spine cover to the spine.

8. The document storage device of claim 1, wherein the translucent material is colored.

9. The document storage device of claim 1, wherein each of the first and second portions are substantially planar.

10. The document storage device of claim 1, wherein the hinge is substantially entirely within the pocket when the spine insert is inserted in the pocket.

11. The document storage device of claim 1, wherein the sleeve member is substantially symmetrical about the hinge.

12. The document storage device of claim 1, wherein the sleeve member is sized to be smaller than the spine such that no portion of the sleeve member extends beyond the spine when inserted into the pocket.

13. A method of labeling the spine of a document storage device having a spine pocket, the method comprising:

providing a spine label;

at least partially surrounding the spine label with a sleeve member to define a spine insert;

inserting the spine insert into the spine pocket; and leaving the spine insert in the pocket until the label is changed, wherein the sleeve member includes a first portion and a second portion connected along a hinge, and wherein at least partially surrounding the spine label with a sleeve member includes inserting the spine label between the first and second portions, and wherein inserting the spine insert into the spine pocket includes inserting the sleeve member into the spine pocket in a direction parallel to the hinge.

14. The method of claim 13, wherein inserting the spine insert into the spine pocket includes inserting the sleeve member into the pocket such that substantially the entire hinge is within the pocket.

15. The method of claim 13, wherein the sleeve member includes a tab at one end, and wherein inserting the spine insert into the spine pocket includes inserting the spine insert such that substantially only the tab extends out of the pocket.

16. The method of claim 13, wherein the sleeve member includes opposite ends with a tab at each of the opposite ends, and wherein inserting the spine insert into the spine pocket includes inserting the spine insert such that one of the tabs extends out of a first end of the pocket and the other of the tabs extends out of a second end of the pocket.

17. The method of claim 13, wherein at least partially surrounding the spine label with a sleeve member includes completely surrounding the spine label with the sleeve member such that no portion of the spine label extends from the sleeve member.

18. The method of claim 13, wherein at least partially surrounding the spine label with a sleeve member includes at least partially surrounding the spine label with a translucent sleeve member so that the spine label can be viewed through the sleeve member.

19. A method of labeling the spine of a document storage device having a spine pocket, the method comprising:

providing a spine label;

at least partially surrounding the spine label with a sleeve member to define a spine insert;

inserting the spine insert into the spine pocket; and leaving the spine insert in the pocket until the label is changed;

wherein the sleeve member includes opposite ends with a tab at each of the opposite ends, and wherein inserting the spine insert into the spine pocket includes inserting the spine insert such that one of the tabs extends out of a first end of the pocket and the other of the tabs extends out of a second end of the pocket.

20. A document storage device configured to receive a spine label, the document storage device comprising:

a spine;

a spine cover cooperating with the spine to define a pocket; and a sleeve member operable to at least partially surround the spine label to define a removable spine insert that is inserted into the pocket, the sleeve member remaining in the pocket with the spine label and removable from the pocket to remove the spine label;

wherein the spine cover and the spine cooperate to define a snap-fit to attach the spine cover to the spine.

* * * * *